US008139007B2

(12) United States Patent
Mizutani et al.

(10) Patent No.: US 8,139,007 B2
(45) Date of Patent: Mar. 20, 2012

(54) LIGHT-EMITTING DEVICE, DISPLAY DEVICE, AND METHOD FOR CONTROLLING DRIVING OF THE LIGHT-EMITTING DEVICE

(75) Inventors: Yasushi Mizutani, Musashimurayama (JP); Kazunori Morimoto, Sagamihara (JP); Tsuyoshi Ozaki, Fuchu (JP)

(73) Assignee: Casio Computer Co., Ltd., Tokyo (JP)

( * ) Notice: Subject to any disclaimer, the term of this patent is extended or adjusted under 35 U.S.C. 154(b) by 534 days.

(21) Appl. No.: 12/413,772

(22) Filed: Mar. 30, 2009

(65) Prior Publication Data

US 2009/0244047 A1 Oct. 1, 2009

(30) Foreign Application Priority Data

Mar. 31, 2008 (JP) ..... 2008-091882
Mar. 31, 2008 (JP) ..... 2008-092020
Feb. 20, 2009 (JP) ..... 2009-038663

(51) Int. Cl.
*G09G 3/32* (2006.01)

(52) U.S. Cl. ..... 345/82; 345/211

(58) Field of Classification Search ..... 345/76–100, 345/204, 211
See application file for complete search history.

(56) References Cited

U.S. PATENT DOCUMENTS 7,248,255 B2 7/2007 Yoshida
7,514,989 B1 * 4/2009 Somerville et al. ..... 327/543
7,518,577 B2 4/2009 Akimoto et al.
7,652,644 B2 * 1/2010 Lee et al. ..... 345/75.2
7,696,794 B2 * 4/2010 Feldtkeller ..... 327/137
2008/0030438 A1 2/2008 Marx et al.
2008/0180365 A1 * 7/2008 Ozaki ..... 345/76
2008/0218499 A1 9/2008 Kohno et al.
2010/0073265 A1 * 3/2010 Hirai et al. ..... 345/55
2010/0188318 A1 * 7/2010 Ishii et al. ..... 345/76

FOREIGN PATENT DOCUMENTS

CN 1523558 A 8/2004
JP 2002-156923 A 5/2002
JP 2005-156697 A 6/2005
JP 2007-536585 T 12/2007
JP 2008-224863 A 9/2008
KR 10-2009-0057855 A 6/2009
WO WO 2007/037269 A1 4/2007

OTHER PUBLICATIONS

Japanese Office Action dated Apr. 20, 2010 and English translation thereof in counterpart Japanese Application No. 2008-092020.

(Continued)

*Primary Examiner* — Nitin Patel
(74) *Attorney, Agent, or Firm* — Holtz, Holtz, Goodman & Chick, PC

(57) ABSTRACT

A light-emitting device comprises a power supply line, at least one data line, at least one pixel having a light-emitting element with one end electrically connected to the power supply line and another end set to a prescribed potential, and a first transistor connecting the data line(s) and one end of the light-emitting element, a current supplying circuit that outputs a verification current of a preset value, and a data driver unit having voltage measuring circuits that acquire a voltage of the one end of the light-emitting element as the verification voltage when the verification current flows via a current path of the data line and the first transistor of the pixel, from the one end of the light-emitting element to the other end from the current supplying circuit via the power supply line.

29 Claims, 20 Drawing Sheets

OTHER PUBLICATIONS

Korean Office Action dated Nov. 16, 2010 (and English translation thereof) in counterpart Korean Application No. 10-2009-0027722.

Chinese Office Action dated May 18, 2011 (and English translation thereof) in counterpart Chinese Application No. 200910128346.9.

* cited by examiner

FIG. 4

| VEL (V) | BRIGHTNESS (cd / $m^2$) | EFFICIENCY ($\eta$) |
|---|---|---|
| 7.85 | 5000 | 1.00 |
| 7.90 | 4600 | 0.92 |
| 8.00 | 3950 | 0.79 |
| 8.10 | 3500 | 0.70 |
| 8.20 | 3150 | 0.63 |
| 8.30 | 3000 | 0.60 |

LIGHT-EMITTING DEVICE, DISPLAY DEVICE, AND METHOD FOR CONTROLLING DRIVING OF THE LIGHT-EMITTING DEVICE

BACKGROUND OF THE INVENTION

1. Field of the Invention

The present invention relates to a light-emitting device, a display device, and a method for controlling driving of the light-emitting device, and particularly relates to a light-emitting device including light-emitting elements at pixels, a display device equipped with this light-emitting device, and a method for controlling driving of the light-emitting device.

2. Description of the Related Art

In the related art, light-emitting devices having light-emitting elements such as organic ELs, inorganic ELs, or LEDs as light-emitting elements for pixels, with each of the pixels then being arranged in a column or in a matrix and the light-emitting elements of each pixel then emitting light, and light-emitting element type displays (display devices) that carry out display using such light-emitting devices are well-known.

Active matrix driving method light-emitting element displays in particular are superior from the point of view of high brightness, high contrast, fine detail, and low power consumption, etc. Organic EL elements are being taken particular note of.

Devices that drive organic EL elements using a plurality of transistors so as to obtain brightness for provided image data by controlling current to the organic EL elements exist as display devices (light-emitting devices) having organic EL elements as pixels (for example, Unexamined Japanese Patent Application KOKAI Publication No. 2002-156923).

Such display devices perform control so that the organic EL elements emit light at the desired brightness by writing data (gate voltages) across the gates and sources of transistors controlling the flow of current to the organic EL elements based on the brightness of the supplied image data.

It is well-known that light-emitting efficiency of organic EL elements gradually falls with continued illumination as a result of the flow of current as resistance gradually increases. However, the aforementioned display device cannot measure the voltages across the terminals of the organic EL elements and detection of changes in the characteristics of the organic EL elements is therefore difficult. It is therefore not possible to carry out drive control corresponding with changes to the characteristics of the organic EL elements.

By resolving the problems of the related art, the present invention is advantageous in providing a light-emitting device, a display device, and a method for controlling driving of the light-emitting device capable of carrying out drive control while taking into consideration changes in the characteristics of the light-emitting elements.

A further advantage of the present invention is in providing a light-emitting device, a display device, and a method for controlling driving of the light-emitting device that is capable of carrying out driving taking into consideration changes in the characteristics of the light-emitting elements.

SUMMARY OF THE INVENTION

In order to bring about the aforementioned advantages, a light-emitting device of the present invention comprises:

a power supply line;

at least one data line;

at least one pixel having a light-emitting element with one end electrically connected to the power supply line and another end set to a prescribed potential, and a first transistor connecting the data line(s) and one end of the light-emitting element;

a current supplying circuit that outputs a verification current of a preset value; and a data driver unit having voltage measuring circuits that acquire a voltage of the one end of the light-emitting element as the verification voltage when the verification current flows via a current path of the data line and the first transistor of the pixel, from the one end of the light-emitting element to the other end from the current supplying circuit via the power supply line.

The data driver unit includes a correction circuit that corrects drive data according to externally supplied image data based on the verification voltages acquired by the voltage measuring circuits, and a drive signal supplying circuit that generates a drive signal based on the corrected drive data.

The correction circuit further comprises:

a light-emitting efficiency extraction unit having a storage circuit pre-stored with a relationship between a light-emitting efficiency indicating a ratio of brightness with respect to an initial brightness when the light-emitting element possesses initial characteristics when the verification current flows at the light-emitting element and a voltage across terminals of the light-emitting element when the verification current flows in the light-emitting element, that extracts a value for the light-emitting efficiency corresponding to the verification voltage measured by the voltage measuring circuit based on the relationship between the light-emitting efficiency and the voltage across the terminals of the light-emitting element stored in the storage circuit; and an operation unit that carries out operations on the drive data based on the values for light-emitting efficiency extracted by the light-emitting efficiency extraction unit and corrects the drive data.

The light-emitting device further comprises a light-emitting region where a plurality of the pixels are arranged.

The voltage measuring circuits of the data driver unit are controlled so as to acquire the verification voltage for one of the pixels of the plurality of pixels of the light-emitting region.

A plurality of the pixels are arranged along a row direction and a column direction at the light-emitting region.

A plurality of the data lines are arranged along the column direction of the light-emitting region.

The light-emitting device comprises a plurality of select lines arranged in a row direction orthogonal to each of the data lines and connected to each of the pixels at the light-emitting region, and select driver units that apply select signals to each of the select lines and set each of the pixels corresponding to each of the select lines to a selected state.

Each of the pixels is arranged in a matrix in the vicinity of intersection points of each of the data lines and each of the select lines, with each of the pixels comprising a second transistor with one end of a current path connected to the power supply line and the other end of the current path connected to one end of the light-emitting element so as to electrically connect the power supply line and one end of the light-emitting element, and a voltage holding unit that holds a voltage across a control terminal of the second transistor and the other end of the current path.

The drive signal supplying circuit applies a first write voltage having a voltage value necessary for causing a current larger than the verification current to flow at the current path of the second transistor as a drive signal to the pixel that acquisition of the verification voltage is carried out for of the row put into a selected state by the select driver unit before the verification current flows in the light-emitting element. The drive signal supplying circuit also puts the second transistor in a conducting state, and applies a second write voltage of a value that puts the second transistor in a non-conducting state as a drive signal to the pixels of the row put into a selected state by the select driver unit with the exception of the one pixel the verification voltage is acquired for.

Each of the pixels comprises a third transistor with one end of a current path connected to the power supply line and the other end of the current path connected to the control terminal of the second transistor.

The plurality of select lines comprise a plurality of first select lines connected to a control terminal of the third transistor of each of the pixels so as to be arranged in a row direction, and a plurality of second select lines connected to a control terminal of the first transistor of each of the pixels so as to be arranged in a row direction.

The select driver unit comprises a first select driver unit that applies first select signals to each of the first select lines, and a second select driver unit that applies second select signals to each of the second select lines.

Conducting states are set individually for the first transistor and the third transistor by the first select driver unit and the second select driver unit.

Each of the pixels comprises a third transistor with one end of a current path connected to the power supply line and the other end of the current path connected to the control terminal of the second transistor.

The plurality of select lines comprise a plurality of first select lines connected to a control terminal of the first transistor of each of the pixels so as to be arranged in a row direction, and a plurality of second select lines connected to a control terminal of the third transistor of each of the pixels so as to be arranged in a row direction.

The select driver unit may comprise:

a first select driver unit that applies a first select signal to each of the first select lines, and a second select driver unit comprising a switch circuit having a plurality of switching elements that apply the second select signal to each of the second select lines based on the first select signal, and a switch driver circuit that controls the operation of each of the transistors of the switch circuit.

Conducting states are set individually for the first transistor and the third transistor by the first select driver unit and the second select driver unit.

The switch circuit may comprise a plurality of first switching elements provided corresponding to each of the rows of the light-emitting region, with one end of a current path connected to each of the second select lines, and the other end of the current path being set to a prescribed potential, a plurality of second switching elements provided corresponding to each of the rows of the light-emitting region, connecting both ends of a current path to the first select lines and the second select lines connected to the pixels of each of the rows, a first control signal line connected in common to the control terminals of each of the first switching elements, and a second control signal line connected in common to the control terminals of each of the second switching elements.

The switch drive circuit individually applies control signals for controlling conduction of each of the first switching elements and each of the second switching elements to the first control signal line and the second control signal line.

The light-emitting device further comprises a light-emitting region where a plurality of the pixels are arranged.

The plurality of pixels are arranged along a row direction and a column direction in a matrix at the light-emitting region.

A plurality of the data lines are arranged along the column direction of the light-emitting region.

Current outputted from the current supplying circuit flows simultaneously to the light-emitting elements for all of the pixels of the light-emitting region.

A plurality of the voltage measuring circuits of the data driver unit are provided corresponding to each of the plurality of data lines, each of the voltage measuring circuits are arranged along the column direction of the light-emitting region and acquire average values for the verification voltages of the plurality of pixels connected individually to the plurality of data lines.

The light-emitting device further comprises a light-emitting region where a plurality of the pixels are arranged.

The plurality of pixels are arranged in a matrix along the row direction and the column direction at the light-emitting region.

A plurality of the data lines are arranged along the column direction.

Current outputted from the current supplying circuit flows simultaneously to the light-emitting elements for the plurality of pixels arranged along any one row of the light-emitting region.

A plurality of the voltage measuring circuits of the data driver unit are provided corresponding to each of the plurality of data lines, and each of the voltage measuring circuits acquires the verification voltages of each of the pixels arranged along the one row of the light-emitting region in parallel.

A display device also comprises:

a power supply line;

a plurality of data lines;

a plurality of pixels having a light-emitting element connected to any of the plurality of data lines, with one end electrically connected to the power supply line and at the end set at a prescribed potential, and a first transistor connecting each of the data lines and one end of the light-emitting element;

a current supplying circuit that outputs a verification current of a preset value; and a data driver unit having voltage measuring circuits that acquire a voltage of one end of a light-emitting element when a verification current flows from one end of the light-emitting element to the other end from the current supplying circuit via the power supply line via a current path of each of the data lines and the first transistor of at least one pixel of the plurality of pixels as a verification voltage, a correction circuit that corrects drive data according to externally supplied image data based on the verification voltages acquired by the voltage measuring circuits, and a drive signal supplying circuit that generates a drive signal based on the corrected drive data.

The correction circuit further comprises:

a light-emitting efficiency extraction unit having a storage circuit pre-stored with a relationship between a light-emitting efficiency indicating a ratio of brightness with respect to an initial brightness when the light-emitting element possesses initial characteristics when the verification current flows at the light-emitting element and a voltage across terminals of the light-emitting element when the verification current flows in the light-emitting element, that extracts a value for the light-emitting efficiency corresponding to the verification voltage measured by the voltage measuring circuit based on the relationship between the light-emitting efficiency and the voltage across the terminals of the light-emitting element stored in the storage circuit; and an operation unit that carries out operations on the drive data based on the values for light-emitting efficiency extracted by the light-emitting efficiency extraction unit and corrects the drive data.

The display device further comprises a light-emitting region where a plurality of the pixels are arranged.

The voltage measuring circuits of the data driver unit are controlled so as to sequentially acquire the verification voltages every one of the pixels of the plurality of pixels of the light-emitting region.

The display device further comprises a light-emitting region where the plurality of pixels are arranged in a matrix along to a row direction and a column direction, A plurality of the data lines are arranged along the column direction of the light-emitting region.

Current outputted from the current supplying circuit flows simultaneously to the light-emitting elements for all of the pixels of the light-emitting region.

A plurality of the voltage measuring circuits of the data driver unit are provided corresponding to each of the plurality of data lines, each of the voltage measuring circuits are arranged along the column direction of the light-emitting region and acquire average values for the verification voltages of the plurality of pixels connected individually to the plurality of data lines.

The display device further comprises a light-emitting region where the plurality of pixels are arranged in a matrix along to a row direction and a column direction, A plurality of the data lines are arranged along the column direction.

Current outputted from the current supplying circuit flows simultaneously to the light-emitting elements for the plurality of pixels arranged along any one row of the light-emitting region.

A plurality of the voltage measuring circuits of the data driver unit are provided corresponding to each of the plurality of data lines, and each of the voltage measuring circuits acquires the verification voltages of each of the pixels arranged along the one row of the light-emitting region in parallel.

In a method for controlling driving of a light-emitting device for driving a light-emitting device having light-emitting elements, the light-emitting device has at least one pixel having a power supply line, at least one data line, a light-emitting element with one end electrically connected to the power supply line and another end set to a prescribed potential, and a first transistor connecting the data line and one end of the light-emitting element, and a current supplying circuit that outputs a verification current having a preset value, and the method comprises the steps of:

having the verification current flow from the current supplying circuit from one end of the light-emitting element to the other end of the light-emitting element via the power supply line; and acquiring a voltage of the one end of the light-emitting element when the verification current flows from the one end of the light-emitting element to the other end of the light-emitting element via a current path of the data line and the first transistor.

The method may also include the steps of: correcting drive data corresponding to externally supplied image data based on the acquired value of the verification voltage; and generating a drive signal based on the connected drive data and supplying the drive signal to the pixel(s) via the data line.

The step of correcting the drive data may also comprise the steps of:

extracting a value for the light-emitting efficiency corresponding to the verification voltage acquired in the step of acquiring the voltage of the one end of the light-emitting element based on the relationship between the light-emitting efficiency and the voltage across the terminals of the light-emitting element stored in the storage circuit pre-storing a relationship between the light-emitting efficiency indicating a ratio of brightness with respect to an initial brightness when the light-emitting element possesses initial characteristics when the verification current flows at the light-emitting element and a voltage across the terminals of the light-emitting element when the verification current flows in the light-emitting element; and carrying out operations on the drive data so as to correct the drive data based on the extracted light-emitting efficiency.

The light-emitting device further comprises a light-emitting region where a plurality of the pixels are arranged along a row direction and a column direction.

In the step of the verification current flowing from one end of the light-emitting element to the other end, the verification current outputted by the current supplying circuit flows out the light-emitting element of one of the pixels of the plurality of pixels of the light-emitting region.

The step of acquiring the voltage of the one end of the light-emitting element may include sequentially measuring the verification voltages of the plurality of pixels arranged at the light-emitting region.

The light-emitting device may further comprise a light-emitting region where the plurality of the pixels are arranged along a row direction and a column direction, with a plurality of the data lines being arranged along the column direction.

In the step of the verification current flowing from one end of the light-emitting element to the other end, the verification current outputted by the current supplying circuit flows at the light-emitting elements of all of the pixels of the light-emitting region simultaneously.

The step of acquiring the voltage of the one end of the light-emitting element may also include a step of measuring an average value for the verification voltages for the plurality of pixels arranged along a column direction of the light-emitting region.

Alternatively, the light-emitting device may further comprise a light-emitting region where the plurality of the pixels are arranged along a row direction and a column direction, with a plurality of the data lines being arranged along the column direction.

In the step of the verification current flowing from one end of the light-emitting element to the other end, the verification current outputted by the current supplying circuit flows at the light-emitting elements of the plurality of pixels arranged along one row of the light-emitting region simultaneously.

The step of acquiring a voltage of one end of the light-emitting elements may also include a step of acquiring the verification voltages of each of the pixels arranged along the one row of the light-emitting region in parallel.

According to the present invention, it is possible to detect changes in the characteristics of the light-emitting elements. It is also possible to perform drive control taking into consideration changes in the characteristics of the light-emitting elements.

In order to achieve these advantages, a light-emitting device having pixels equipped with light-emitting elements of the present invention may also comprise:

a light-emitting region with the plurality of pixels arranged in the vicinity of intersection points of the plurality of select lines and data lines arranged in a row direction and a column direction; and a data driver unit that generates a drive signal according to externally supplied image data and supplies the drive signal to each of the pixels via the data lines.

Each pixel comprises a current control transistor with one end of a current path connected to the power supply line and the other end of the current path connected to one end of the light-emitting element, that controls the flow of current in the light-emitting element, and a select control transistor with one end of a current path connected to the data line and the other end of the current path connected to a connection point of the other end of the current path of the current control transistor and the light-emitting element, and with a control terminal connected to the select line.

The data driver unit may comprise a plurality of current supplying circuits that supply individual prescribed verification currents to each of the plurality of data lines, and a plurality of voltage measuring circuits that measure the voltages across the terminals of each of the light-emitting elements when the verification currents flow from each of the current supplying circuits via the current path of the select control transistors of each of the pixels at each of the light-emitting elements as verification voltages via the select control transistors.

The light-emitting device may also further comprise a select driver unit that applies select signals to each of the select lines of a display panel and sets selected states at the pixels of each row.

The data driver unit measures the verification voltages for the pixels of a row set to the selected state by the select driver unit.

The data driver unit may comprise a correction circuit that corrects drive data according to the image data based on the verification voltages measured by the voltage measuring circuit, and a drive signal supplying circuit that generates the drive signal based on the corrected drive data.

The correction circuit may comprise a storage circuit that stores a relationship between light-emitting efficiency indicating a ratio of brightness with respect to an initial brightness when the light-emitting element possesses an initial characteristic when the verification current flows at the light-emitting element and a voltage across the end of the light-emitting element when the verification current flows out of the light-emitting element, and a light-emitting efficiency extraction unit that extracts the light-emitting efficiency corresponding to the verification voltage measured by the voltage measuring circuit based on the relationship between the light-emitting efficiency and the voltage across the terminals of the light-emitting element stored in the storage circuit.

The correction circuit may also further comprise an operation unit that performs operations on the drive data so as to correct the drive data based on the values for light-emitting efficiency extracted by the light-emitting efficiency extraction unit.

In a method for controlling driving of a light-emitting device having pixels equipped with light-emitting elements, a plurality of the pixels of the light-emitting device are arranged in the vicinity of each intersection point of a plurality of select lines and data lines arranged in a row direction and a column direction at a light-emitting region, the pixels comprising a current control transistor with one end of a current path connected to the power supply line and the other end of the current path connected to the one end of the light-emitting element, that controls the flow of current in the light-emitting element, and a select control transistor with one end of a current path connected to the data line and the other end of the current path connected to a connection point of the other end of the current path of the current control transistor and the light-emitting element, and with a control terminal connected to the select line.

The method then comprises the steps of:

supplying a prescribed verification current to each of the plurality of data lines, and causing the verification current to flow at each of the light-emitting elements via the current path of the select control transistors of each of the pixels of the rows put into a selected state;

measuring the voltages across the terminals of each of the light-emitting elements as the verification voltages via the select control transistor; and correcting the drive data according to externally supplied image data based on the measured verification voltages.

The step of correcting the drive data may also comprise the steps of:

pre-storing a relationship between light-emitting efficiency indicating a ratio of brightness with respect to an initial brightness when the light-emitting element possesses initial characteristics when the verification current flows to the light-emitting element, and a voltage across the terminals of the light-emitting element when the verification current flows to the light-emitting element;

extracting a value corresponding to the light-emitting efficiency corresponding to the measured verification voltage based on the relationship between the light-emitting efficiency and the voltage across the terminals of the light-emitting element; and correcting the drive data corresponding to the image data based on the extracted light-emitting efficiency.

The verification current flows in the light-emitting elements of each of the pixels for one row of the display panel that is put in the selected state in the step of the verification current flowing; and measuring of the verification voltages of each of the pixels that are arranged the one row of the display panel is executed in parallel in the step of measuring the verification current.

According to the present invention, it is possible to measure fluctuation of the characteristics of the light-emitting elements and compensate for fluctuations in the characteristics of the light-emitting elements.

BRIEF DESCRIPTION OF THE DRAWINGS

FIG. 4 is a diagram showing a Look Up Table (LUT) stored by a light-emitting efficiency extraction unit shown in FIGS. 3 and 17;

DETAILED DESCRIPTION OF THE PREFERRED EMBODIMENTS

The following is an explanation with reference to the drawings of a display device (light-emitting device) of the embodiments of the present invention.

First Embodiment

Figure 1:
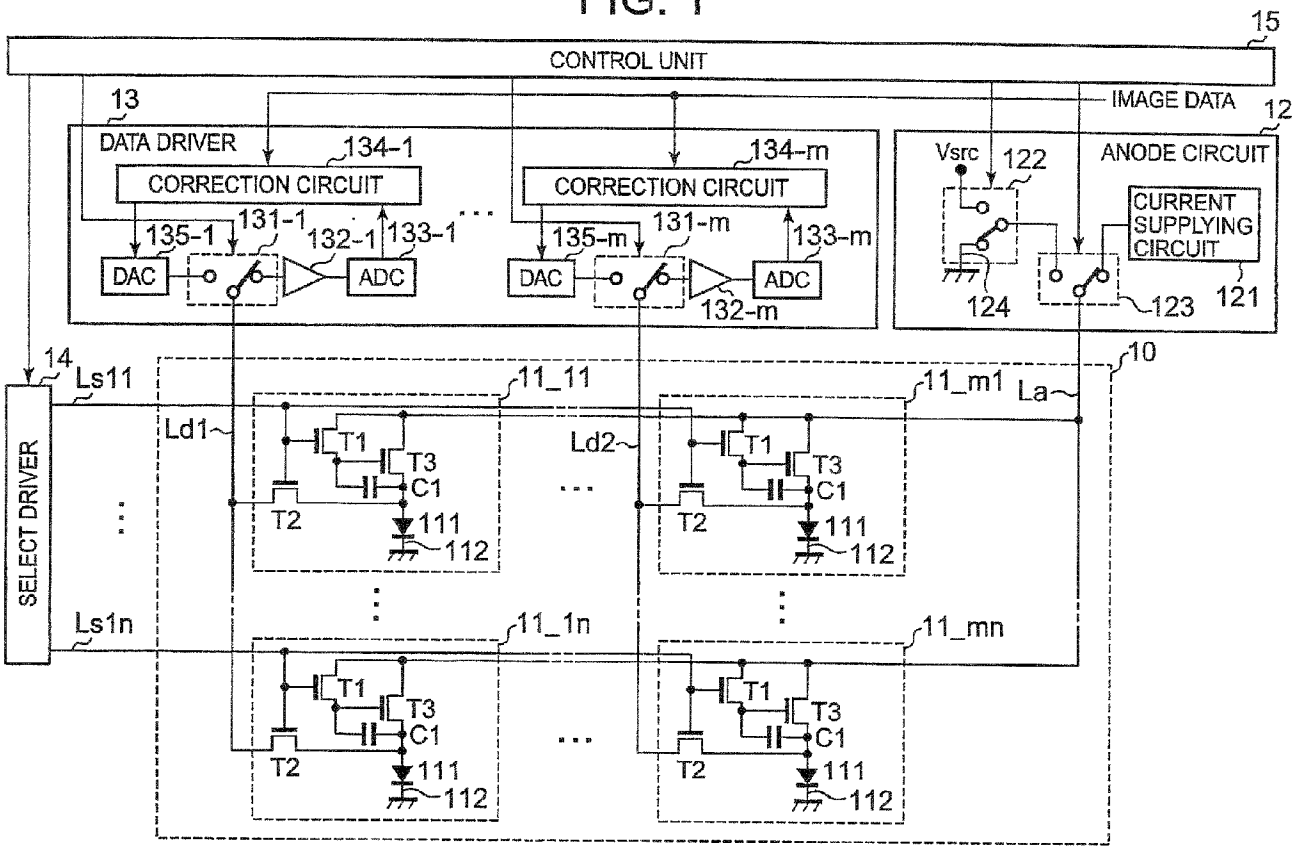
FIG. 1 is a diagram of a configuration for a display device of a first embodiment of the present invention.

A configuration for a display device of a first embodiment is shown in FIG. 1.

A display device of a first embodiment includes a plurality of pixels 11_*ij* (where i=1 to m, j=1 to n, and m, n; natural numbers), a light-emitting region (light-emitting region) 10 where the plurality of pixels 11_*ij* are arranged, an anode circuit (a power supply line driving unit) 12, a data driver (data drive unit) 13, a select driver (select driver unit) 14, and a control unit 15.

Each pixel 11_*ij* corresponds to one pixel of an image. Each of the pixels 11_*ij* are arranged in a matrix in row and column directions at a light-emitting region 10. Each pixel 11_*ij* includes an organic EL element 111 constituting a light-emitting element, and a pixel driver circuit of transistors T1 to T3 and a capacitor (voltage holding unit) C1.

The organic EL element (Organic Electroluminescent Element) 111 is a light-emitting element that utilizes a phenomenon where light is emitted by the occurrence of excitons that occur as the result of recombination of electrons injected into the organic material with positive holes across an anode and a cathode and generates light at a brightness corresponding to a value of a supplied current.

A pixel electrode is formed at the organic EL element 111 and a positive hole injection layer, a light emitting layer, and opposing electrode are formed on the pixel electrodes (none of which are shown in the drawings). The positive hole injection layer is formed on the pixel electrode and has a function for providing positive holes to the light-emitting layer.

The pixel electrodes are made from a conductive material having transparency such as, for example, ITO (Indium Tin Oxide), or Zn, etc. Each pixel electrode is insulated from pixel electrodes for other neighboring pixels by an inter-layer insulating film (not shown).

The positive hole injection layer is made from an organic copolymer material capable of being injected with and carrying positive holes (holes). An aqueous solution of PEDOT/PSS that is a dispersion fluid where, for example, a conductive polymer of polyethylenedioxythiophene (PEDOT) and a dopant of polystyrene sulphonic acid (PSS) are dispersed in a water-based solvent can be used as the organic compound-containing liquid including organic polymer hole injection/carrier material.

The light-emitting layer is formed on an interlayer (not shown). The light-emitting layer has a function for generating light as the result of the application of a prescribed voltage across the anode electrode and the cathode electrode.

The light-emitting layer can be constructed from a well-known high-polymer material that is capable of being fluorescent or phosphorescent such as red (R), green (G), and blue (B) light-emitting material including a conjugated double-bond polymer such as, for example, polyparaphenylene vinylene, or polyfluorine etc.

Further, it is also possible for the light-emitting materials to be formed by applying a fluid (dispersion fluid) dissolved (or dispersed) in an appropriate water-based solvent or an organic solvent such as tetrahydronaphthalene, tetramethylbenzene, mesitylene, or xylene. The solvent is then volatized.

In the case of three colors, the light emitting material for R, G and B for the organic EL element 111 is normally applied every column.

The opposing electrodes have a two-layer structure of a layer of a conductive material that is a material of a low work function such as, for example, Ca, Ba, and a light-reflecting conductive film such as Al and it is connected to an earth line 112 that is connected to earth potential.

A current flows from the pixel electrode to the opposing electrode but does not flow in the opposite direction. The pixel electrode and the opposing electrode therefore constitute an anode electrode and a cathode electrode.

Characteristics of the organic EL element 111 gradually deteriorate as the result of supplying current for driving over a long period of time. Namely, when the characteristics of the organic EL element 111 deteriorate, resistance increases, and it becomes difficult for a current to flow. This means that the brightness of the emitted light falls with respect to the current flowing and the light-emitting efficiency therefore falls.

This is to say that when the characteristics of the organic EL element 111 deteriorate, it is necessary to increase the current provided to the organic EL element 111 in order to obtain the initial brightness. When the current is increased, a voltage VEL across the cathode and anode of the organic EL element 111 also increases.

Figure 2:
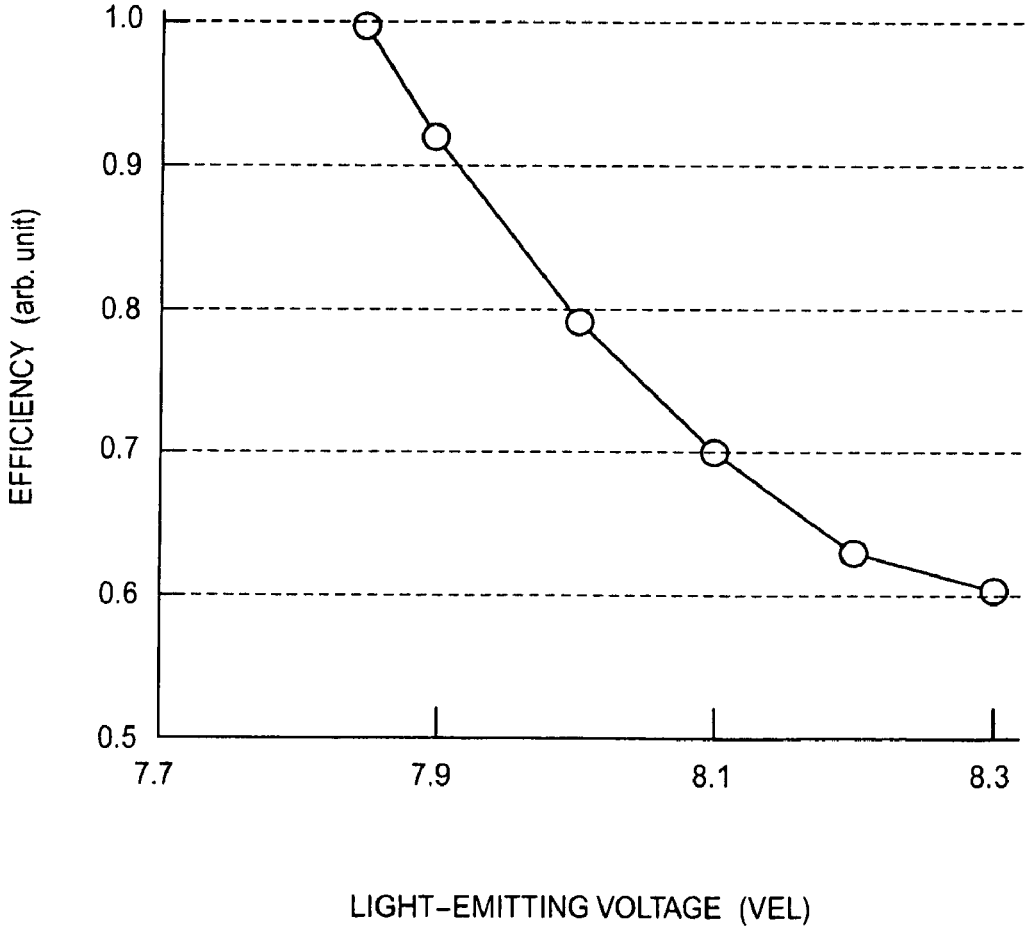
FIG. 2 is a diagram showing the relationship between light-emitting efficiency and voltage for an organic EL element.

There is a correlation between the brightness and the voltage VEL across the cathode and anode of the organic EL element 111. FIG. 2 shows the relationship between light-emitting efficiency $\eta$ and the voltage VEL. The light-emitting efficiency $\eta$ is a parameter indicating change in brightness taking an initial brightness (value) when the organic EL element 111 as its initial characteristics when a fixed current (verification current of an initial current value of Iel_0) flows at the organic EL element 111. FIG. 2 therefore shows to what extent the voltage VEL changes when the light-emitting efficiency $\eta$ changes according to drive time.

This relationship is data acquired by experimentation and is data for when an initial current Iel_0 giving a brightness of 5000 cd/m$^2$ and a brightness per unit area of 16 cd/A flows when the organic EL element 111 has its initial characteristics. Current for the initial current Iel_0 is 5000×(100×300)/16=9.38 (μA) when a surface area of a light emitting unit is taken to be 100 μm×300 μm.

The display device of this embodiment obtains the brightness of the supplied image data taking note of the relationship between the light-emitting efficiency η and the voltage VEL by measuring the voltage (verification voltage) VEL when the initial current Iel_0 flows at the organic EL element 111 and correcting the provided current based on this voltage VEL.

The transistors T1 to T3 are TFTs (Thin-Film Transistors) constituted by n-channel FETs (Field Effect Transistors).

The transistor T1 (third transistor, write control transistor) is a switching transistor for switching the transistor T3 (second transistor, current control transistor) on and off.

A drain (terminal) for the transistor T1 for each pixel 11_*ij* is connected to an anode line (power supply line) La.

A gate (terminal) of the transistor T1 for each pixel 11_11 to 11_*ml* is connected to a select line (select line) Ls11. Similarly, the gate of the transistor T1 for each of the pixels 11_12 to 11_*m*2 is connected to the select line (select line) Ls12, . . . , and the gate of the transistor R1 for each of the pixels 11_1*n* to 11_*mn* is connected to a select line (select line) Ls1*n*.

In the case of the pixel 11_11, when an on (high) level signal is outputted to the select line Ls11 from the select driver 14, the transistor T1 is put on, and the transistor T3 is also put on.

When an off (low) level signal is outputted to the select line Ls11, the transistor T1 is put off, and the transistor T3 is also put off. When this happens, when the transistor T1 is put off, charge charged at a capacitor C11 is retained.

The transistor T2 (first transistor, select control transistor) is a switching transistor that is selected by the select driver 14 to go on and off so as to cause conduction and stop conduction across the anode circuit 12 and the data driver 13.

A drain that is one end of the transistor T2 of each pixel 11_*ij* is connected to an anode (electrode) of the organic EL element 111.

A gate (terminal) of the transistor T2 for each pixel 11_11 to 11_*ml* is connected to the select line Ls11. Similarly, the gates of the transistors T2 for each pixel 11_12 to 11_m2 are connected to the select line Ls12, . . . , and the gates of the transistors T2 for each of the pixels 11_*n* to 11 nm are connected to the select line Ls1*n*.

Sources that are at the other end of the transistors T2 for each of the pixels 11_11 to 11_1*n* are connected to the data line Ld1. Similarly, the sources of the transistors T2 of each of the pixels 11_21 to 11_2*n* are connected to the data line Ld2, . . . and the sources of the transistors T2 for each of the pixels 11_*ml* to 11_*mn* are connected to the data line Ldm.

In the case of pixel 11_11, when an on level signal is outputted to the select line Ls11 from the select driver 14, the transistors T2 go on, and the anodes of the organic EL elements 111 and the data line Ld1 are connected.

When an off level signal is outputted to the select line Ls11, the transistors T2 go off, and the anode of the organic EL element 111 and the data line Ld1 are disconnected.

The transistors T3 therefore function so as to enable a current provided from the anode circuit 12 to flow at the organic EL elements 111 while measuring the voltages VEL.

When measuring the voltages VEL, the drains of the transistors T3 of each pixel 11_*ij* are current input terminals inputting a current provided by the anode circuit 12 and are connected to the anode line La. The sources are current output terminals that output a current and are connected to the anodes of the organic EL elements 111. The gates are control terminals that control current flowing across the drains and the sources and are connected to the sources of the transistors T1.

The capacitors C1 are capacitors that hold voltages Vgs (hereinafter referred to as "gate voltage Vgs") across the gates and sources of the transistors T3. One end of the capacitor C1 is connected to the source of the transistor T1 and the gate of the transistor T3, and the other end is connected to the source of the transistor T3 and the anode of the organic EL element 111.

When the transistor T1 is put on, the gate and drain of the transistor T3 are connected so as to be connected as a diode and be on. The capacitor C1 is therefore charged by a current across the drain and source of the transistor T3 from the anode line La so as to be charged by the gate voltage Vgs of the transistor T3 at this time, with this charge being stored.

The capacitor C1 then holds the gate voltage Vgs of the transistor T3 when the transistors T1 and T2 are put off.

The anode circuit 12 also has a function for supplying current for measuring use to each pixel 11_ij via the anode line La when measuring the voltage VEL. The anode circuit 12 also has a function for setting the anode line La to an earth potential and a prescribed voltage (voltage Vsrc) of a potential higher than the earth potential when carrying out an operation of writing data to each pixel 11_ij and when carrying out a light emitting operation corresponding to image data for the organic EL element 111 for each pixel 11_ij. The anode circuit 12 includes a current supplying circuit 121, switches 122, 123, an earth line 124 connected to earth potential, and a constant voltage source that outputs a voltage Vsrc.

The current supplying circuit 121 is a current supply that supplies a current of a preset current value. The switch 122 is selectively connected to the voltage Vsrc or the earth line 124 and one end of the switch 123. The switch 123 is selectively connected to an output terminal of the current supplying circuit 121 and an output terminal of the switch 122.

The data driver 13 has a function for writing data to the organic EL element 111 of each pixel 11_*ij*, and includes switches 131-1 to 131-*m*, buffer units 132-1 to 132-*m*, A/D converters 133-1 to 133-*m*, correction circuits 134-1 to 134-*m*, and DACs (D/A converters: drive signal providing circuits) 135-1 to 135*m*.

The switches 131-1 to 131-*m* are selectively connected to the data lines Ld1 to Ldm, and the input terminals of the buffer units 132-1 to 132-*m* or the output terminals of D/A converters 135-1 to 135-*m*.

The buffer units 132-1 to 132-*m* are for preventing current from flowing in from each pixel 11_*ij* and are constituted by, for example, an operation amplifier with a high input impedance. The buffer units 132-1 to 132-*m* supply an analog voltage VEL that is measured to the A/D converters 133-1 to 133-*m* via the data lines Ld1 to Ldm.

The A/D converters 133-1 to 133-*m* are for measuring the analog voltages VEL supplied from the buffer units 132-1 to 132-*m* and converting the measured analog voltages VEL to digital voltages VEL. The A/D converters 133-1 to 133-*m* then supply the converted digital voltages VEL to the correction circuits 134-1 to 134-*m*. Each of the buffer units 132-1 to 132-*m* and the A/D converters 133-1 to 133-*m* connected to each of the buffer units 132-1 to 132-*m* correspond to the voltage measuring circuit of the present invention.

The correction circuits 134-1 to 134-*m* are circuits that correct values for drive data Vdata according to the image data based on the voltages VEL supplied by the A/D converters 133-1 to 133-*m* so as to acquire a brightness corresponding to the supplied image data.

Figure 3:
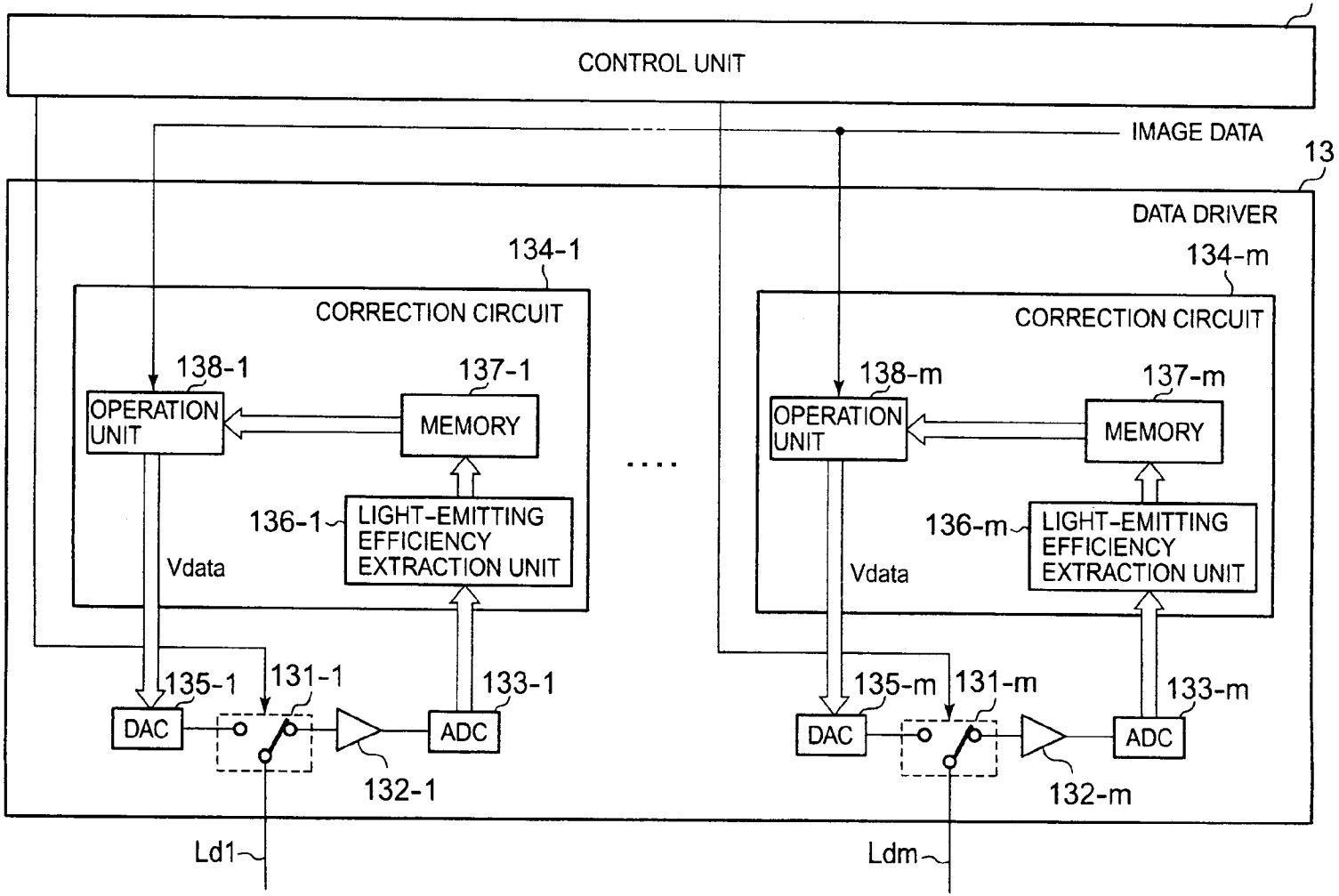
FIG. 3 is a diagram showing a configuration the correction circuit shown in FIG. 1.

As shown in FIG. 3, the correction circuits 134-1 to **134-*m* include light-emitting efficiency extraction units 136-1 to 136-*m*, memories 137-1 to 137-*m*, and operation units 138-1 to 138-*m***.

The light-emitting efficiency extraction units 136-1 to **136-*m* are for extracting the light-emitting efficiencies η corresponding to the respective voltages VEL acquired through measurement and have the LUT (Look Up Table, storage circuit) shown in FIG. 4**.

This LUT is a table showing the relationship between the voltage VEL, the brightness, and the light-emitting efficiency η and is made based on the relationship between the light-emitting efficiency η and the voltage VEL shown in FIG. 2.

This LUT shows the relationship between the change in brightness when a current of an initial value Iel_0 flows at the organic EL element 111 and the light-emitting efficiency η and the voltage VEL.

This LUT shows that when a current of the initial value Iel_0 required for obtaining a brightness of 5000 cd/m$^2$ when the organic EL element 111 has the initial characteristics flows so that the brightness is 3000 cd/m$^2$, the light-emitting efficiency becomes η=3000/5000=0.60 and the voltage VEL increases to 8.30 V from an initial value of 7.85 V.

In this embodiment, the LUT shows that one type of current is supplied from the current supplying circuit 121 of the anode circuit 12 so as to correspond to one value for the initial current Iel_0 (verification current). However, the present invention is by no means limited in this respect, and the LUT can be taken to correspond to verification currents of a plurality of different current values of two levels or more and can correspondingly supply currents corresponding to different current values of a plurality of corresponding levels from the voltage supplying circuit 121 of the anode circuit 12. In this case, measurement of the voltage VEL is carried out a plurality of times according to the verification currents for each level.

The light-emitting efficiency extraction units 136-1 to **136-*m*** refer to this LUT and extract light-emitting efficiencies η corresponding to the voltages VEL.

The memories 137-1 to **137-*m* are memories (storage circuits) for storing the light-emitting efficiencies η extracted by the light-emitting efficiency extraction units 136-1 to 136-*m***.

The operation units 138-1 to **138-*m*** are respectively supplied with image data and acquire drive data Vdata in order to acquire brightness corresponding to the image data.

The operation units 138-1 to **138-*m* read out the light-emitting efficiencies η from the memories 137-1 to 137-*m*** when writing using the drive data Vdata.

When the organic EL elements 111 have their initial characteristics, the operation units 138-1 to **138-*m* multiply the current Ie1***f*_0 required in order to acquire a brightness corresponding to the supplied image data with the inverse of the light-emitting efficiency η read from the memory 137-1 so as to acquire a current correction value Ie1*f*_1.

The operation units 138-1 to **138-*m* then acquire the drive data Vdata based on the characteristics of the drain-source current with respect to the gate voltage of the transistors T3 of each of the pixels 11**_*ij* and the current correction value Ie1*f*_1.

The D/A converters 135-1 to **135-*m* then convert digital drive data Vdata obtained by the operation units 138-1 to 138-*m*** to a drive signal Vd (negative voltage) that is an analog write voltage.

The D/A converters 135-1 to **135-*m* then draw in currents from the transistors T3 via the transistors T2 by applying the drive signal Vd that is the write voltage to the other ends of the transistors T2 of each pixel 11_1***j* to 11_*mj* via the data lines Ld11 to Ld1*m*.

The select driver 14 is for selecting a pixel 11_*ij* every row under the control of the control unit 15 and is, for example, a shift register. The select driver 14 outputs on or off level signals to the select lines Ls11 to Ls1*n*.

The control unit 15 is for controlling each unit. The control unit 15 controls each unit so as to acquire the required brightness's by correcting the values of current supplied when writing the drive signal based on fluctuation of the voltage VEL of the organic EL element 111.

This means that the control unit 15 controls each unit so as to measure the voltage VEL of the organic EL elements 111 of each pixel 11_*ij* and write a drive signal Vd that is a write voltage across the gate-sources of the transistors T3 of each of the pixels 11_*ij* so that the organic EL elements 111 emit light.

The display device of the first embodiment measures the voltage VEL every one column. The display device measures this voltage VEL, for example, every time the power supply is turned on, every one day, or every fixed time period of usage.

When the voltage VEL is measured every one column, the control unit 15 controls the anode circuit 12, the data driver 13, and the select driver 14 so that a current flows from the anode circuit 12 to the earth line 112 via the organic EL elements 111 of each of the pixels 11_*ij*.

When writing of the drive data Vdata is carried out, the control unit 15 controls the anode circuit 12, the data driver 13, and the select driver 14 so that current doesn't flow from the anode circuit 12 to the organic EL elements 111 of each of the pixels 11_*ij* but does flow at the data driver 13.

When the organic EL elements 111 emit light, the control unit 15 controls the anode circuit 12, the data driver 13, and the select driver 14 based on the gate voltages Vgs of the transistors T3 written to the capacitors C1 of each of the pixels 11_*ij* so that currents are supplied to the organic EL elements 111.

Next, an explanation is given of the operation of the display device of the first embodiment.

First, an explanation is given of the operation while measuring the voltages VEL of the organic EL elements 111 of each of the pixels 11_*ij*11.

Figure 5:
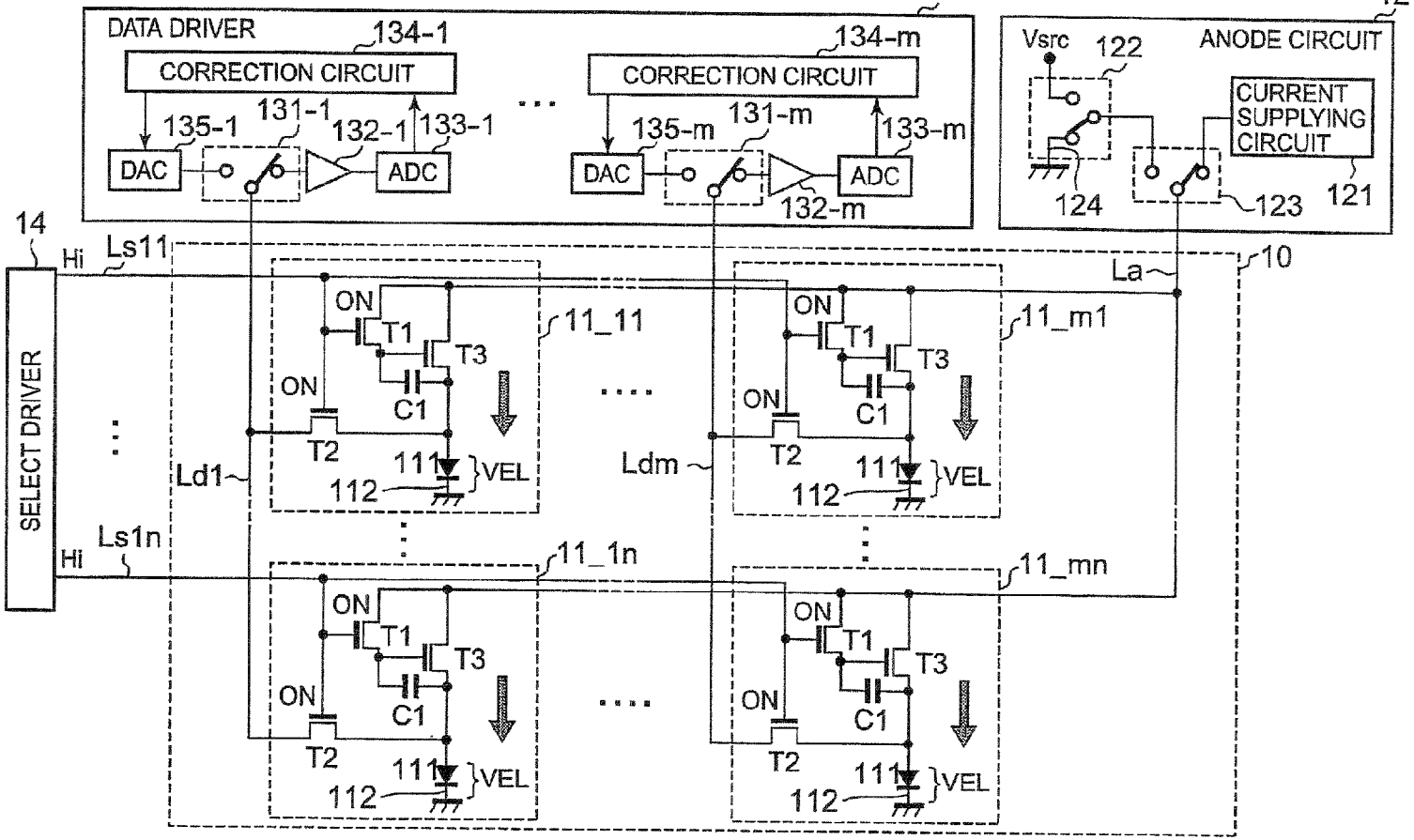
FIG. 5 is a diagram showing an operation for measuring a voltage for the organic EL element (for the case of averaging one column) of the display device shown in FIG. 1.

The display device measures the voltages VEL of the organic EL elements 111 of each of the pixels 11_ij. As shown in FIG. 5, the control unit 15 controls the switch 123 so as to connect the current supplying circuit 121 of the anode circuit 12 and the anode line La in order to measure the voltages VEL.

The control unit 15 controls the switches 131-1 to **131-*m* so as to connect each of the buffer units 132-1 to 132-*m* of the data driver 13 and the data lines Ld1** to Ldm, respectively.

The control unit 15 controls the select driver 14 so as to output an on level signal to all of the select lines Ls11 to Ls1*n*.

The transistors T1 and T2 of all of the pixels 11_*ij* then go on when the select driver 14 outputs an on level signal to the select lines Ls11 to Ls1*n*. When the transistor T1 goes on, the gate and drain of the transistor T3 are connected, the transistor T3 goes on, and the diode operates.

Figure 6:
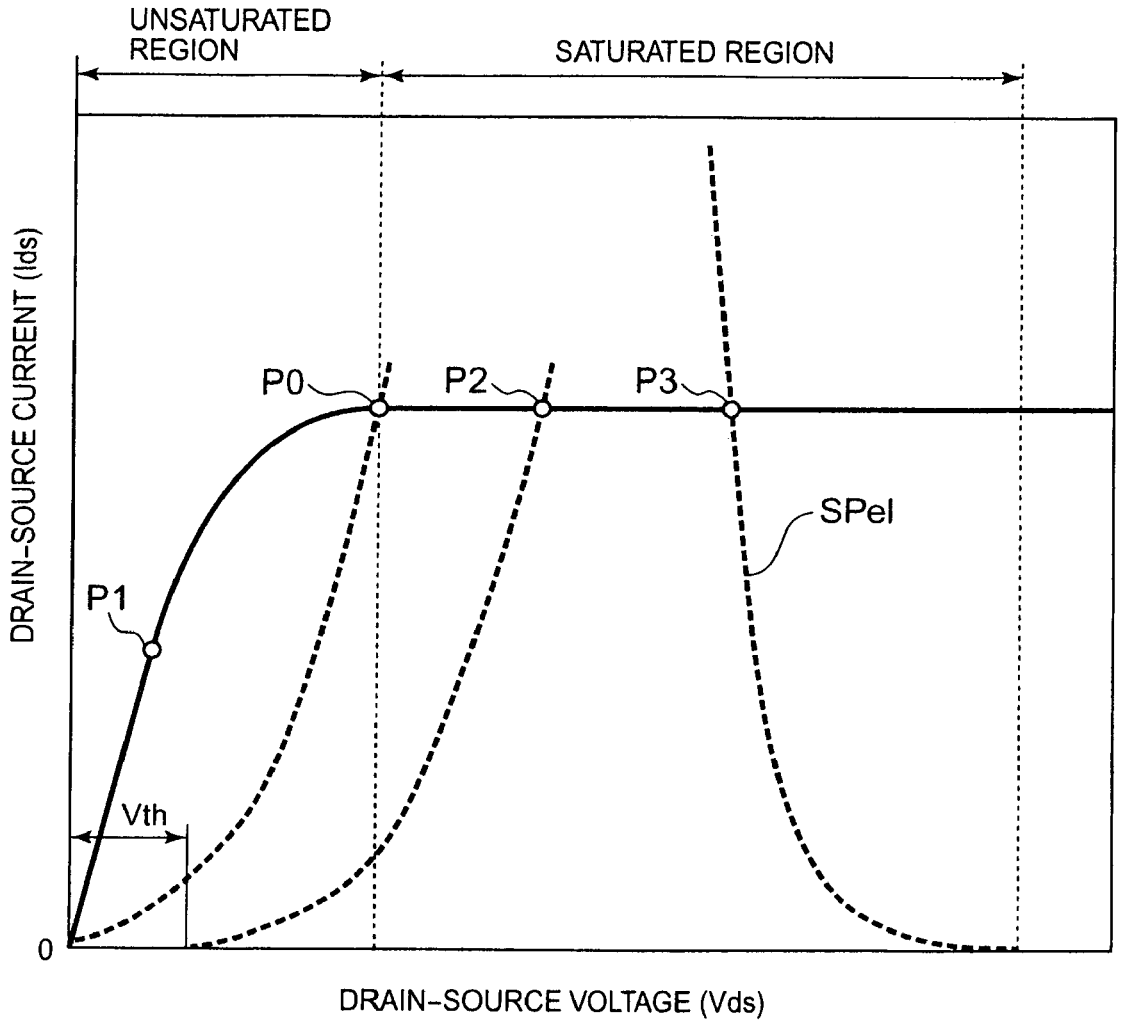
FIG. 6 is a diagram showing an operating region (the relationship between drain voltage and drain current) for the transistor shown in FIGS. 1 and 16.

FIG. 6 is a diagram showing a characteristic for a drain-source current Ids versus a drain-source voltage Vds for a transistor T3 and a load line SPe1 for the organic EL element 111. An operating point for the transistor T3 is that shown by P3 of FIG. 6 that is an intersection point for a Vds versus Ids characteristic line for the transistor T3 and a load line Spe1 for the organic EL element 111, with operation taking place in the saturation region.

In FIG. 6, P0 is a pinch off point, Vth is a threshold voltage, a region from where the voltage Vds across the drain and source is 0 V to the pinch-off voltage is an unsaturated region, and a region from where the drain-source voltage Vds is the pinch-off voltage or more is a saturation region.

When the transistors T1 to T3 for all of the pixels 11_ij are put on, current supplied from the current supplying circuit 121 flows so as to be distributed between all of the transistors T3 of the pixels 11_ij because the current supplying circuit 121 and the anode line La are connected.

The value of the current supplied from the current supplying circuit 121 is set to a current value such that an average value for the current flowing at each of the pixels 11_ij is equal to the value of the initial current Iel_0.

A current does not flow at the data driver 13 because each of the buffer units 132-1 to 132-*m* of the data driver 13 are at a high impedance. This means that a current flows to the earth line 112 via all of the organic EL elements 111 of the pixels 11_*ij*.

The buffer units 132-1 to 132-*m* acquire voltages for the data lines Ld1 to Ldm via the switches 131-1 to 131-*m*. An on resistance of the transistors T2 of each of the pixels 11_*ij* is therefore of a value that can be substantially ignored because the gate voltage Vgs is high. The voltages of the data lines Ld1 to Ldm respectively acquired by the buffer units 132-1 to 132-*m* therefore become the voltages VEL of the organic EL elements 111.

Further, the voltage of the data line Ld1 becomes the voltage VEL averaged for each of the organic EL elements 111 of the pixels 11_11 to 11_1*n* for one column because the anodes for each of the organic EL elements 111 are connected to the data line Ld1 via each of the transistors T2 of the pixels 11_11 to 11_1*n* for one column. The buffer 132-1 supplies this voltage VEL to the A/D converter 133-1.

Similarly, the buffers 132-2 to 132-*m* supply voltages VEL averaged every column of organic EL elements 111 for the pixels 11_*ij* connected to the data lines Ld2 to Ldm to the A/D converters 133-1 to 133-*m* via the switches 131-2 to 131-*m*.

In this way, the A/D converters 133-1 to 133-*m* measure the voltages VEL for the organic EL elements 111 averaged every column using analog values via the buffer units 132-1 to 132-*m*. The A/D converters 133-1 to 133-*m* then convert the analog voltages VEL to digital voltages VEL. The buffer units 132-1 to 132-*m* and the A/D converters 133-1 to 133-*m* therefore constitute the voltage measuring circuit of the present invention.

The light-emitting efficiency extraction units 136-1 to 136-*m* of the correction circuits 134-1 to 134-*m* refer to the LUTs and extract light-emitting efficiencies η corresponding to a digital voltages VEL converted by the A/D converters 133-1 to 133-*m*. The light-emitting efficiency extraction units 136-1 to 136-*m* then store the extracted light-emitting efficiencies η in the memories 137-1 to 137-*m*.

Next, an explanation is given of the operation while driving each of the organic EL elements 111 of the pixels 11_*ij* based on the image data.

Figure 7:
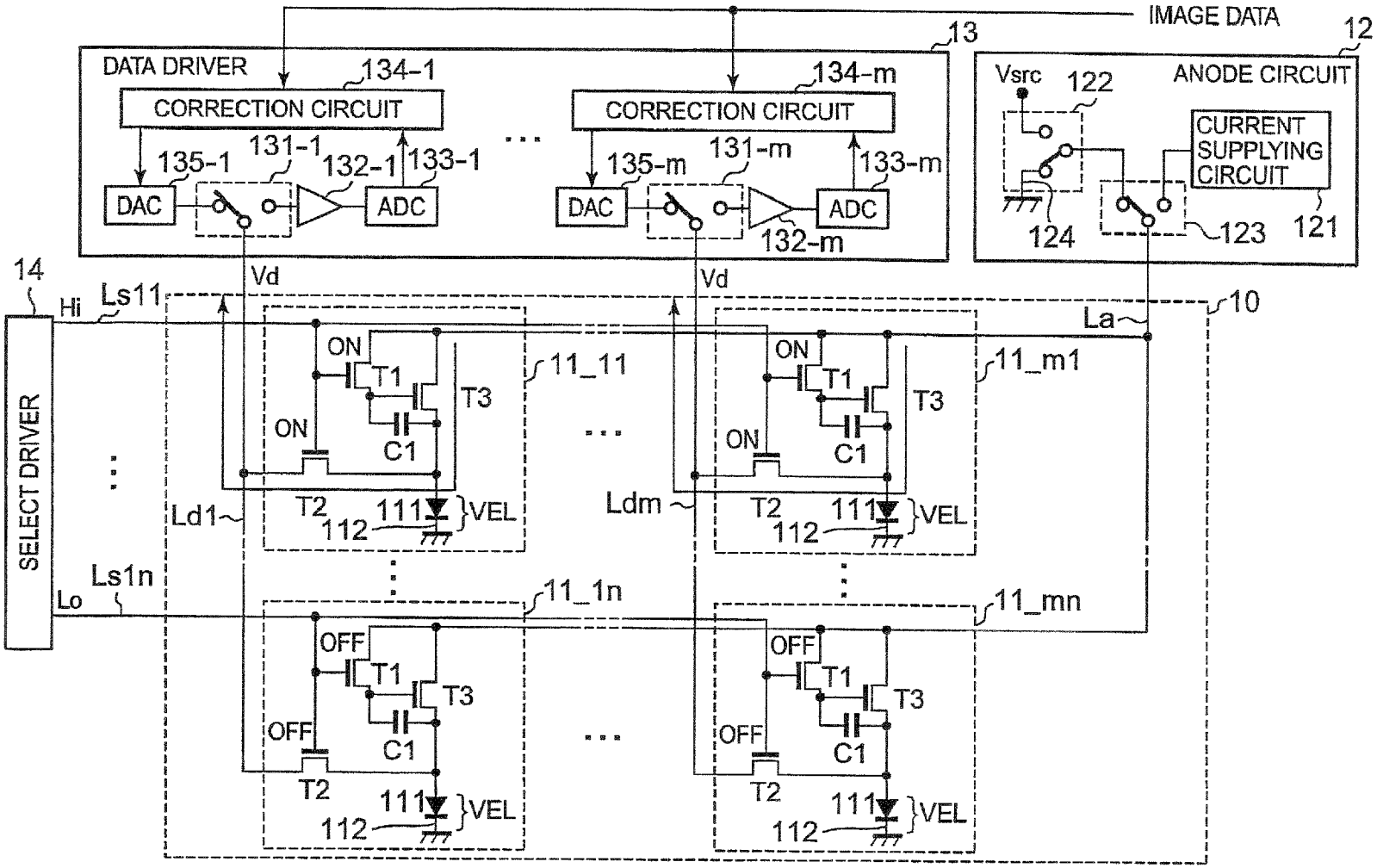
FIG. 7 is a diagram showing a write operation for a display operation occurring at the display device shown in FIG. 1.

When the image data is supplied, the display device writes the drive data Vdata for each of the pixels 11_11 to 11_*mn*. At this time, the control unit 15 controls the switches 122 and 123 of the anode circuit 12 so that the anode line La becomes earth potential, as shown in FIG. 7. The switch 122 connects the earth line 124 and one end of the switch 123, the switch 123 connects one end of the switch 123 and the anode line La, and the anode line La is connected to the earth line 124.

Next, the control unit 15 outputs an on level signal to the select line Ls11, controls the select driver 14 so as to output off level signals to the select lines Ls12 to Ls1*n*, and selects the pixels 11_11 to 11_*ml*.

The operation units 138-1 to 138-1 read-out light-emitting efficiencies η for each of the pixels 11_11 to 11_*ml* from the memories 137-1 to 137-*m*, and obtain drive data Vdata based on the read-out light-emitting efficiencies η.

Each of the D/A converters 135-1 to 135-*m* of the data driver 13 convert the drive data Vdata obtained by the operation units 138-1 to 138-1 to a drive signal Vd that is an analog write voltage.

The control unit 15 controls the switches 131-1 to 131-*m* so that each of the D/A converters 135-1 to 135-*m* of the data driver 13 and the data lines Ld1 to Ldm are connected.

Each of the D/A converters 135-1 to 135-*m* of the data driver 13 apply the drive signal Vd that is an analog converted write voltage to the data lines Ld1 to Ldm.

The anode line La is at earth potential, and the potential of the cathode of the organic EL elements 111 of each of the pixels 11_11 to 11_*ml* are also connected to earth potential. The current therefore does not flow to the organic EL elements 111 of each of the pixels 11_11 to 11_*ml*.

The drive signal Vd that is a write voltage is a negative voltage. The current therefore flows from the anode circuit 12 to the D/A converters 135-1 to 135-*m* of the data driver 13 via each of the transistors T3 and T2 of each of the pixels 11_11 to 11_*ml* and the data lines Ld1 to Ldm.

Each of the transistors T1 of each of the pixels 11_11 to 11_*ml* are on. Each of the transistors T3 are therefore connected across the gate and drain so as to be connected as a diode. This means that the transistors T3 operate within the saturation region, a drain current Id flows in the transistors T3 according to a diode characteristic, and the operating point becomes the operating point P2 of FIG. 6.

The transistor T1 is on and a drain current Id flows at the transistor T3. A gate voltage Vgs of the transistor T3 is therefore set to a voltage corresponding to the drain current Id and the capacitor C1 is charged by this gate voltage Vgs.

The data driver 13 therefore draws currents corrected based on the measured voltage VEL from the transistors T3 of each of the pixels 11_11 to 11_*ml* and holds the gate voltages Vgs of the transistors T3 based on the drive data Vdata at the capacitors C1.

In the following, the control unit 15 controls the select driver 14 so as to sequentially select the pixels 11_12 to 11_*m*2, . . . , 11_1*n* to 11_*mn*, and write voltages to the capacitors C1 across the gates and sources of the transistors T3 of each of the pixels 11_11 to 11_*mn* based on the drive data Vdata.

After writing the drive data Vdata to the capacitors C1 across the gate and sources of the transistors T3 for all of the pixels 11_*ij*, the display device causes light to be emitted from the organic EL elements 111 of all of the pixels 11_*ij*.

Figure 8:
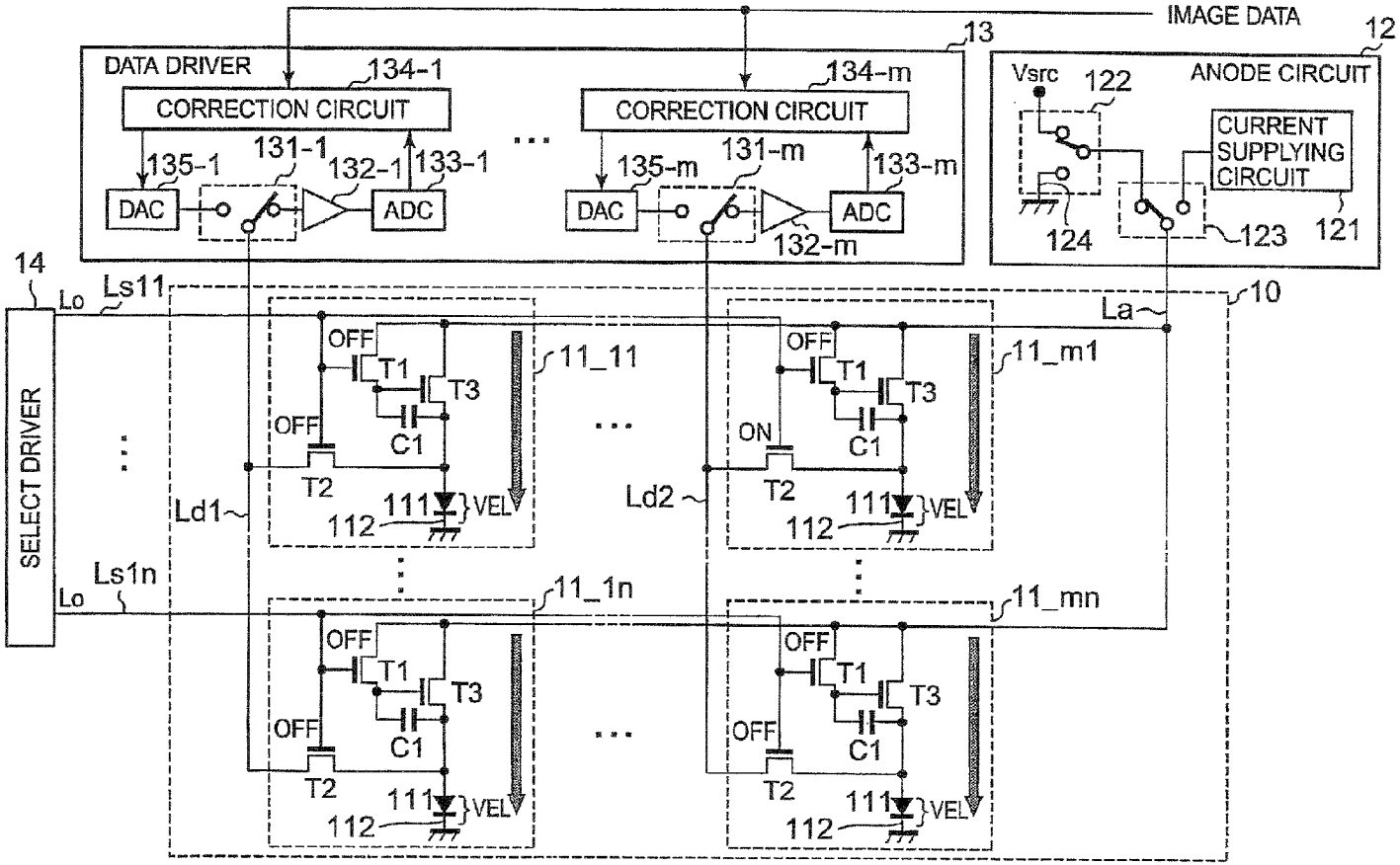
FIG. 8 is a diagram showing a light-emitting operation for a display operation occurring at the display device shown in FIG. 1.

At this time, as shown in FIG. 8, the control unit 15 controls a select driver 14 so that off level signals are outputted at all of the select lines Ls11 to Ls1*n* and the transistors T1 and T2 for all of the pixels 11_*ij* are put off.

At all of the pixels 11_*ij*, the transistors T3 are unselected when the transistors T1 and T2 are put off. When the transistors T3 are unselected, the voltages across the gate and sources of the transistors T3 are held at the voltages written to the capacitors C1.

At this time, the control unit 15 controls the switches 122 and 123 of the anode circuit 12 so that the voltage Vsrc is applied to the anode line La. This voltage Vsrc is set to be in the order of, for example, 12 V.

The gate voltage Vgs of the transistor T3 is then held by the capacitor C1. As shown in FIG. 6, the operating point of the transistor T3 then becomes an operating point P3 that is an intersection point of an operating line of the retained gate voltage Vgs and a load line SPe1 of the organic EL element 111. The voltage Vsrc is set to be a voltage where the operating point P3 is such that the transistor T3 operates in the saturation region.

A drain current Id that is the same as the write current when the drive data Vdata is written in flows across the drain and source of the transistor T3. The transistor T2 is therefore off and the potential of the anode side of the organic EL element 111 is higher than the potential of the cathode side. This drain current Id can therefore be supplied to the organic EL element 111.

At this time, the current Id flowing at the organic EL elements 111 of each of the pixels 11_*ij* can be corrected based on the measured voltage VEL.

For example, if correction does not take place when brightness corresponding to the supplied image data with respect to the organic EL element 111 of the pixel 11_11 is 5000 cd/m$^2$ and the voltage VEL measured for the organic EL element 111 is 8.30 V, the brightness is 3000 cd/m$^2$ or less.

In this event, the light-emitting efficiency extraction unit 136-1 acquires a light-emitting efficiency $\eta$=0.6 from the voltage VEL=8.30 V by referring to the LUT shown in FIG. 4.

The operation unit 138-1 refers to the memory 137-1 and acquires=0.6 and acquires a current correction value Iel_1 that is an initial current value Iel_0 of $1/\eta$=1.67 times as the current for acquiring a brightness of 5000 cd/m$^2$.

This is to say that correction takes place so that a current that is 1.67 times the initial current Iel_0 flows at the organic EL element 111 of the pixel 11_11. As a result, the organic EL element 111 emits light at a brightness of 5000 cd/m$^2$.

As described above, according to the first embodiment, the control unit 15 exerts control in such a manner that the transistors T1 and T2 of each of the pixels 11_*ij* go on after writing of the drive data Vdata to each of the pixels 11_*ij*. The control unit 15 also controls the anode circuit 12 in such a manner that current is supplied to the organic EL elements 111 from the anode circuit 12 via the transistors T3 of each of the pixels 11_*ij*.

The data driver 13 includes the buffer units 132-1 to 132-*m* that have a high input impedance.

This means that the A/D converters 133-1 to 133-*m* of the data driver 13 can measure the voltage VEL averaged every column of the organic EL elements 111 of each pixel 11_*ij* via the high impedance buffer units 132-1 to 132-*m*.

The correction circuits 134-1 to 134-*m* correct currents supplied to the organic EL elements 111 based on the voltages VEL measured by the A/D converters 133-1 to 133-*m* so as to obtain the brightness of the supplied image data and acquire the drive data Vdata.

The control unit 15 exerts control so that the anode circuit 12 becomes earth potential that is the same potential as the organic EL element 111. Each of the D/A converters 135-1 to 135-*m* of the data driver 13 then apply the drive signal Vd that is a negative write voltage to the data lines Ld1 to Ldm.

It is therefore possible to carry out writing using the drive data Vdata corresponding to the brightness of the supplied image data in accordance with measured values for the voltage VEL. This means that it is possible for the organic EL elements 111 to emit light at a brightness corresponding to the supplied image data even after having been driven for a long time.

In the case of the three primary colors of R, G, and B, the light emitting material for the colors R, G, and B is usually applied every column. However, the extent of deterioration of an organic EL element 111 also differs for different materials. However, in the first embodiment, the voltage VEL averaged every column is measured. It is therefore possible to measure the voltage VEL averaged for organic EL elements 111 generated for the same material without having to take into consideration distinctions between the materials.

Second Embodiment

A display device of a second embodiment measures the voltage of each organic EL element every row.

In image displaying, current flowing every row is different when the frequency of displaying lateral lines is higher. The values of the voltages VEL are therefore different every row. The display device of the second embodiment therefore measures the voltage VEL every row in order to measure the voltage VEL accurately even in this kind of case.

The display device of the second embodiment has the same configuration as for the first embodiment shown in FIG. 1.

Next, an explanation is given of the operation of the display device of the second embodiment.

Figure 9:
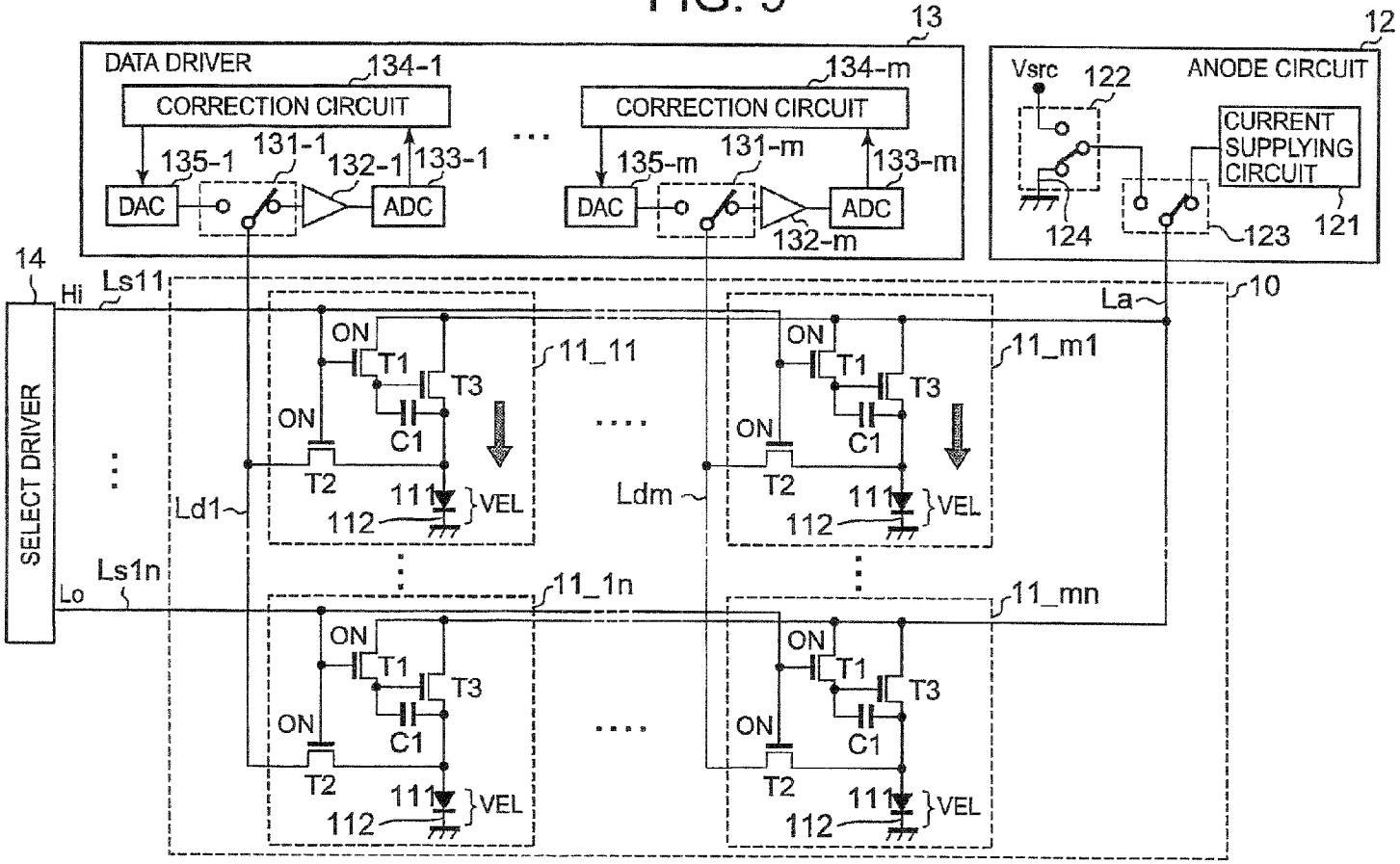
FIG. 9 is a diagram showing a voltage measuring operation (in the case of averaging for one row) for an organic EL element occurring at a display device of a second embodiment of the present invention.

In the operation for measuring the voltage VEL, the control unit 15 measures the voltages VEL of the organic EL elements 111 for each pixel 11_ij of each row. As shown in FIG. 9, the control unit 15 controls the switch 123 so that the current supplying circuit 121 of the anode circuit 12 and the anode line La are connected.

The control unit 15 controls the switches 131-1 to 131-*m* so as to connect each of the buffer units 132-1 to 132-*m* of the data driver 13 and the data lines Ld1 to Ldm, respectively.

Next, the control unit 15 outputs an on level signal to the select line Ls11, controls the select driver 14 so as to output off level signals to the select lines Ls12 to Ls1*n*, and selects the pixels 11_11 to 11_*ml* of the first row.

When the select driver 14 outputs an off level signal to the select lines Ls12 to Ls1*n*, the transistors T1 to T3 of the pixels 11_12 to 11_*m*2, . . . , 11_1*m* to 11_*mn* are put off.

The current supplied from the current supplying circuit 121 therefore does not flow at the pixels 11_12 to 11_m2, . . . , 11_1*n* to 11_mn because the transistors T1 to T3 of the pixels 11_12 to 11_*m*2, . . . , 11_1*n* to 11_mn are put off.

When the select driver 14 outputs an on level signal to the select line Ls11, the transistors T1 and T2 of the pixels 11_11 to 11_*ml* for the first row are put on. But in the case of the first embodiment, the gates and drains of the transistors T3 are connected so that the transistor T3 goes on and operates as a diode in the saturation region, and the operating point becomes P2 of FIG. 6.

When the transistors T1 to T3 of the pixels 11_11 to 11_ml are put on, current supplied from the current supplying circuit 121 is distributed between the transistors T3 of the pixels 11_11 to 11_ml because the current supplying circuit 121 and the anode line La are connected.

The value of the current supplied from the voltage supplying circuit 121 is set to be a value that ensures that the average value of the currents flowing at each of the pixels 11_11 to 11_*ml* for one row is equal to the value of the initial current Iel_0.

A current does not flow at the data driver 13 because each of the buffer units 132-1 to 132-*m* of the data driver 13 are at a high impedance. Because of this, current flows via the organic EL elements 111 of the pixels 11_11 to 11_*ml* to the earth line 112.

The buffer units 132-1 to 132-*m* of the data driver 13 acquire the voltages of the data lines Ld1 to Ldm via the switches 131-1 to 131-*m*.

As the on resistance of the transistors T2 of the pixels 11_11 to 11_*ml* can be ignored, the voltages acquired by the buffer units 132-1 to 132-*m* become the voltages VEL of each of the organic EL elements 111 of the pixels 11_11 to 11_*ml*.

The voltages respectively acquired by the buffer units 132-1 to 132-*m* are then supplied to the A/D converters 133-1 to 133-*m*. The A/D converters 133-1 to 133-*m* then convert the analog voltages measured for the organic EL elements 111 of the pixels 11_11 to 11_*ml* via the buffer units 132-1 to 132-*m* to digital voltages VEL that are supplied to the correction circuits 134-1 to 134-*m*.

The light-emitting efficiency extraction units 136-1 to 136-*m* of the correction circuits 134-1 to 134-*m* average the digital voltages VEL converted by the A/D converters 133-1 to 133-*m*, refer to the LUT, and extract the light-emitting efficiencies η corresponding to the average value for the voltages VEL for one row.

The light-emitting efficiency extraction units 136-1 to 136-*m* then store the extracted light-emitting efficiencies η in the memories 137-1 to 137-*m*.

When the light-emitting efficiencies η are stored in the memories 137-1 to 137-*m*, the control unit 15 selects the pixels 11_12 to 11_*m*2 for the second row, acquires the voltages VEL for each of the pixels 11_12 to 11_*m*2 as with the first row, extracts and the light-emitting efficiencies η corresponding to the average value for the voltages VEL every row, and stores the corresponding light-emitting efficiencies η in the memories 137-1 to 137-*m*.

The control unit 15 then sequentially selects the pixels 11_13 to 11_*mn* for each row and the memories 137-1 to 137-*m* store the light-emitting efficiencies η corresponding to the average value for the voltages VEL every row.

As with the first embodiment, when the image data is supplied, in the display operation for the organic EL elements 111 for each pixel 11_*ij* based on the image data, the display device writes in drive data Vdata for each pixel 11_11 to 11_*mn*.

At this time, as with the first embodiment, the control unit 15 sequentially selects the pixels 11_11 to 11_*ml*, . . . , 11_1*n* to 11_*mn*.

The operation units 138-1 to 138-*m* of the data driver 13 then read out the light emitting efficiencies η for the pixels 11_*ij* for each row selected by the control unit 15 from the memories 137-1 to 137-*m*. The current is then corrected based on the read out light-emitting efficiencies η and the drive data Vdata is obtained.

The D/A converters 135-1 to 135-*m* then convert drive data Vdata obtained by the operation units 138-1 to 138-*m* to a drive signal Vd that is an analog negative write voltage, and the drive data Vdata is written across the gates and sources of the transistors T3 of the pixels 11_*ij* for each row selected by the control unit 15 using the drive signal Vd that is this negative write voltage.

When the display device carries out writing for the pixels 11_*ij* for all of the rows, the organic EL elements 111 for each of the pixels 11_*ij* are made to emit light as in the first embodiment.

As described above, according to this embodiment, the display device measures the voltages VEL of the organic EL elements 111 for each pixel 11_*ij* and controls each unit so as to carry out writing.

It is therefore possible to acquire a voltage VEL averaged every row, and in particular, to accurately measure the voltage VEL even in cases where the frequency with which lateral lines are displayed is high and the voltages VEL every row are distinct.

Third Embodiment

A display device of a third embodiment measures the voltage of each organic EL element of each pixel every pixel.

For example, in cases such as for an indicator for a digital camera where displaying takes place for a long time, when an organic EL element 111 partially deteriorates, the voltage VEL becomes different every pixel. The display device of the third embodiment therefore measures the voltage VEL every pixel in order to measure the voltage VEL of each organic EL element 111 accurately even in this kind of case.

Figure 10:
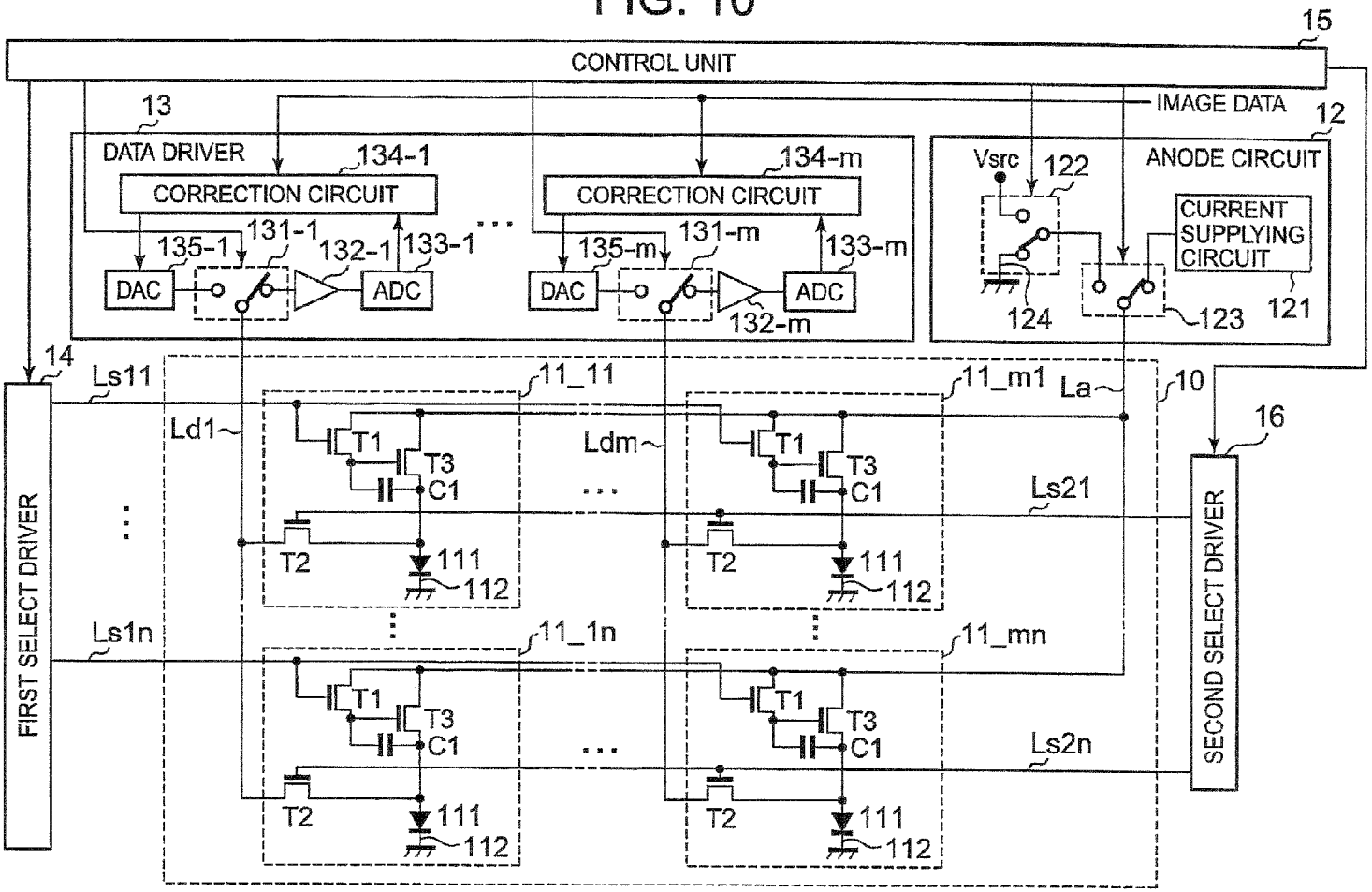
FIG. 10 is a diagram showing a configuration for a display device of a third embodiment of the present invention.

A configuration for a display device of the third embodiment is shown in FIG. 10.

In addition to the first select driver 14 (first select driver unit) of the same configuration as for the first embodiment, the display device of the third embodiment includes a second select driver 16 (second select driver unit). The first select driver 14 is controlled by the control unit 15 so as to put the transistors T1 (third transistor) for each of the pixels 11_*ij* on and off and the second select driver 16 is controlled by the control unit 15 so as to put the transistors T2 for each of the pixels 11_*ij* (first transistor) on and off.

The gates of each of the transistors T2 for the pixels 11_11 to 11_*ml*, 11_12 to 11_*m*2, . . . , 11_1*n* to 11_*mn* are connected to the second select driver 16 via the select lines Ls21 to Ls2*n*.

Next, an explanation is given of the operation of the display device of the third embodiment.

The control unit 15 of the display device controls each unit in such a manner that a row is selected, a pixel 11_*ij* of the selected row is selected, and level voltage writing is carried out only for the one pixel 11_*ij* from within the selected row, with the voltage VEL of the organic EL element 111 then being measured for the pixel 11_*ij* that on level writing has been carried out for.

Figure 11:
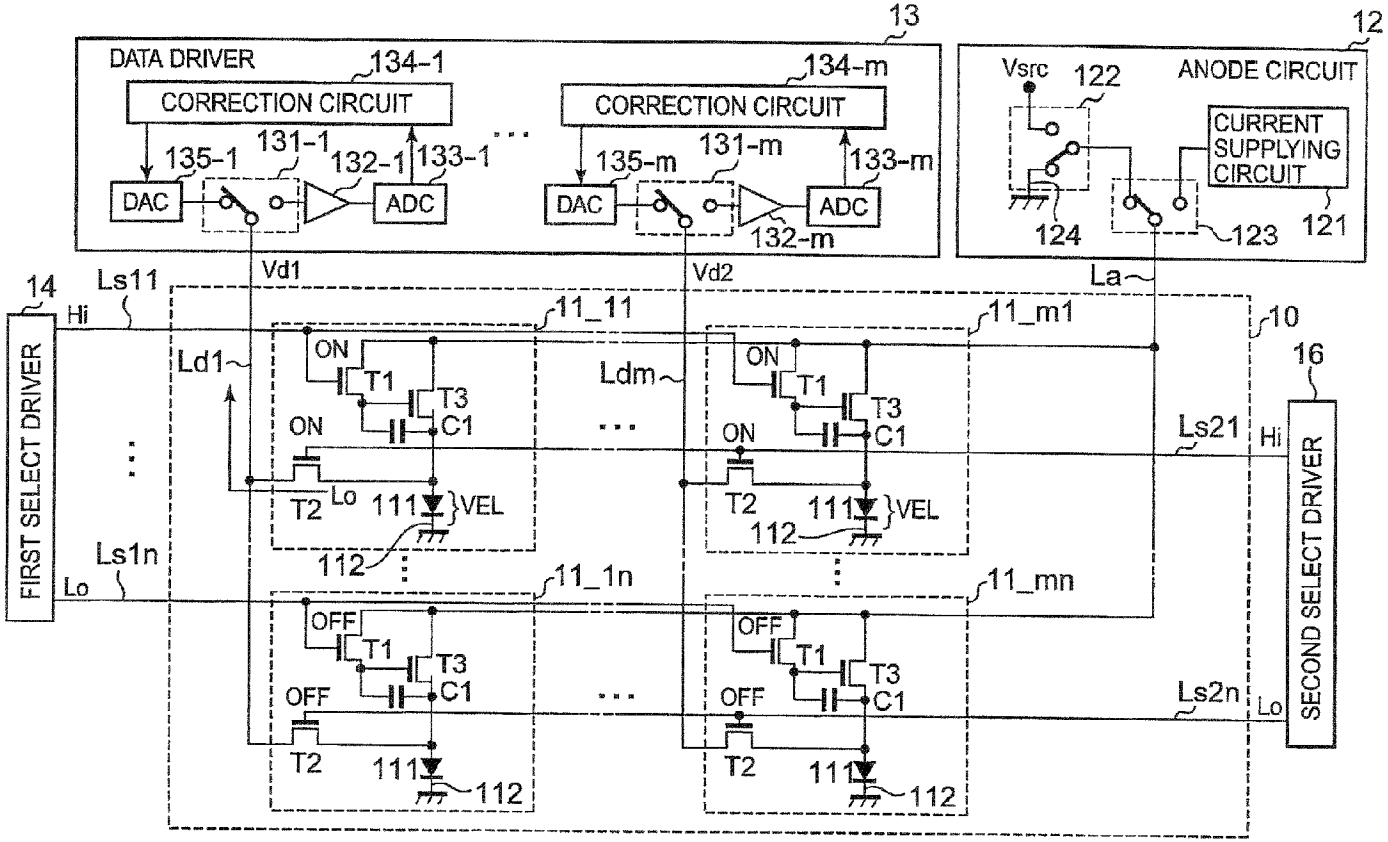
FIG. 11 is a diagram showing a voltage write operation for measuring a voltage of an organic EL element every pixel at the display device shown in FIG. 10.

In the operation of writing voltage to the pixel 11_*ij*, the control unit 15 controls the switches 122 and 123 of the anode circuit 12 in such a manner that, first, as shown in FIG. 11, the anode line La is connected to the earth line 124 so as to be connected to earth potential.

The control unit 15 then controls the first select driver 14 and the second select driver 16 so as to select the pixel 11_11. Namely, the control unit 15 outputs an on level signal to the select line Ls11 and controls the first select driver 14 so as to output off level signals to the select lines Ls12 to Ls1*n*.

Further, the control unit 15 outputs an on level signal to the select line Ls21 and controls the second select driver 16 so as to output off level signals to the select lines Ls22 to Ls2*n*.

The transistors T1 for each of the pixels 11_12 to 11_*m*2, 11_*n* to 11*mn* are also put off when the first select driver 14 outputs an off level signal to the select lines Ls12 to Ls1*n*.

The transistors T2 for each of the pixels 11_12 to 11_*m*2, 11_1*n* to 11_*mn* are also put off when the second select driver 16 outputs an off level signal to the select lines Ls22 to Ls2*n*.

Current does not flow at each of the pixels 11_12 to 11_*m*2, . . . , 11_1*n* to 11_*mn* when the transistors T1 and T2 of the each of the pixels 11_12 to 11_*m*2, 11_1*n* to 11_*mn* are put off.

On the other hand, the transistors T1 of the pixels 11_11 to 11_*ml* are put on when the first select driver 14 outputs an on level signal to the select line Ls11.

The transistors T2 of each of the pixels 11_11 to 11_*ml* are put on when the second select driver 16 outputs an on level signal to the select line Ls21.

When the transistors T1 and T2 of the pixels 11_11 to 11_*ml* are on, the D/A converter 135-1 sets the drive signal that is a write voltage applied to the pixel 11_11 to a drive signal Vd1 that is a first write voltage of a low level sufficiently lower than the potential of the anode line La.

The voltage of a drive signal Vd1 that is a first write voltage is of a value that exceeds a threshold value of the transistor T3 so that the transistor T3 goes on. The value of the current flowing at the pixel 11_11 at the time of writing of the drive signal Vd1 that is this first write voltage is therefore set to a value necessary for giving a current value is larger than the current (initial current Iel_0) supplied from the anode circuit 12 while measuring the voltage VEL thereafter.

On the other hand, the D/A converters 135-2 to **135-*m* set a drive signal that is a write voltage applied to the pixels 11_21 to 11_*ml* to a drive signal Vd2 that is a second write voltage that does not exceed the threshold value of the transistor T3. The transistors T3 for the pixels 11_21 to 11_*ml* are therefore off. The voltage of the drive signal Vd2** that is the second write voltage is, for example, 0 V.

The control unit 15 controls the switches 131-1 to **131-*m* so as to connect the data lines Ld1 to Ldm and the D/A converters 135-1 to 135-*m* of the data driver 13**.

When the data lines Ld1 to Ldm and the D/A converters 135-1 to **135-*m* of the data driver 13 are connected, regarding the data line Ld1, the transistor T3 for the pixel 11_11 is on. This means that a current flows from the earth line 124 of the anode circuit 12, via the anode line La, the transistor T3 of the pixel 11_11, the transistor T2, and the data line Ld1, to the D/A converter 135-1. However, the current does not flow to the organic EL element 111 of the pixel 11_11 because the anode of the organic EL element 111 is at negative potential. A current also does not flow at the data lines Ld2 to Ldm because the transistors T3 of the pixels 11_21 to 11_*ml* are off. A current also does not flow at the organic EL elements 111 of the pixels 11_21 to 11_*ml* because the anodes of the organic EL elements 111** are at earth potential or at negative potential.

The transistor T3 of the pixel 11 is connected as a diode because the transistor T1 is on. The transistor T3 therefore operates within the saturation region and the operating point of this transistor T3 is the operating point P2 of FIG. 6.

Voltage writing of a voltage that causes a current to flow across the drain and source of the transistor T3 is then carried out using a drive signal Vd1 that is a first write voltage across the gate and source of the transistor T3 of the pixel 11_11 for the first row. Voltage writing of a voltage that causes a current not to flow across the drain and source of the transistor T3 is also carried out using a drive signal Vd2 that is a second write voltage across the gates and sources of the transistors T3 of the pixels 11_21 to **11_*ml***.

Figure 12:
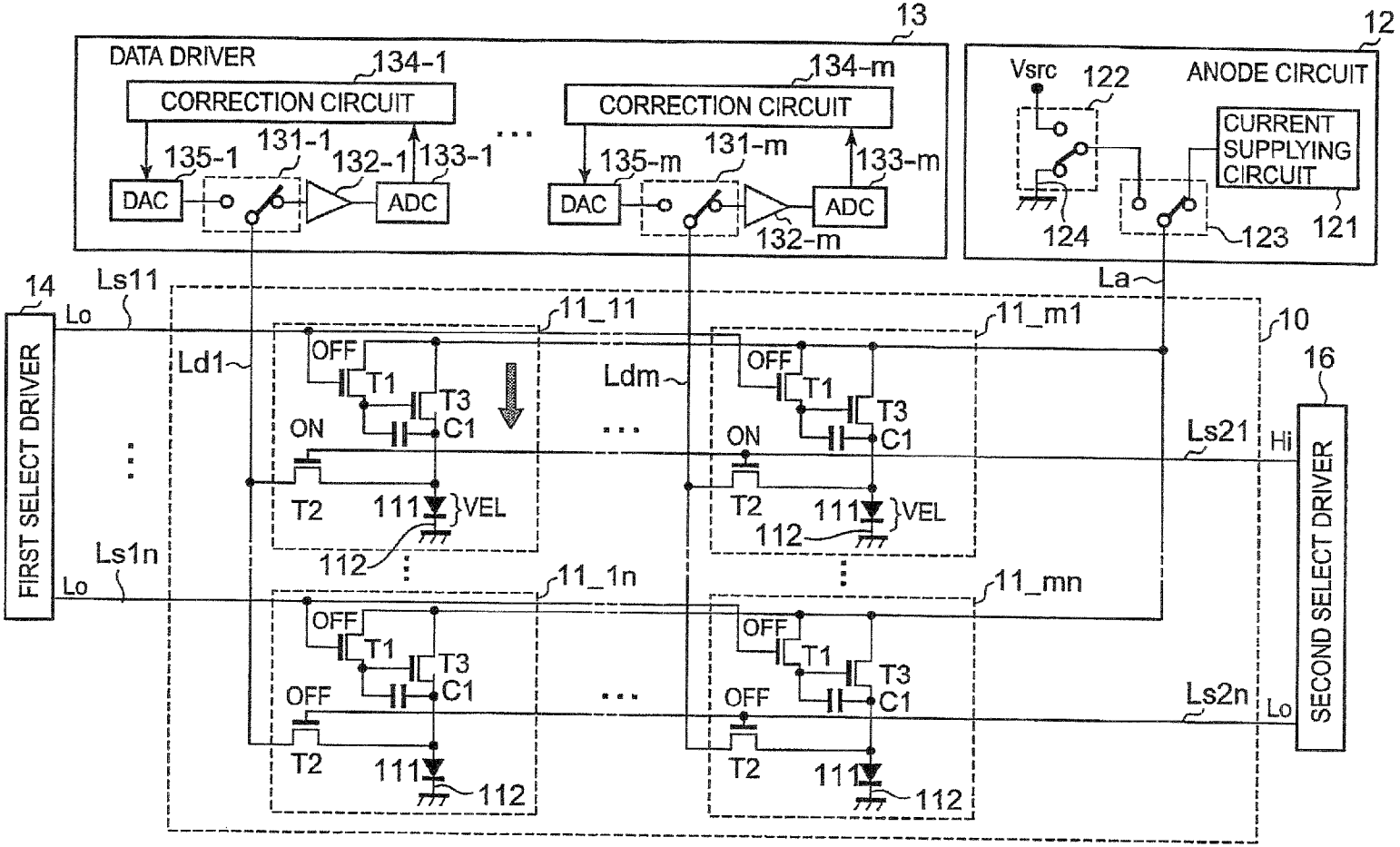
FIG. 12 is a diagram showing an operation for measuring voltage of an organic EL element every pixel at the display device shown in FIG. 10.

Next, after carrying out the voltage writing described above in the operation for measuring the voltage VEL of the pixel 11_11, the control unit 15 controls the switch 123 so that a current is supplied from the current supplying circuit 121 to the anode line La, as shown in FIG. 12. The value of the current supplied by the current supplying circuit 121 is set to be a current value equal to the initial current Iel_0.

The control unit 15 then controls the first select driver 14 so that an off level signal is outputted to the select line Ls11. The control unit 15 then controls the second select driver 16 so that an on level signal continues to be outputted to the select line Ls21.

When an off level signal is outputted at the select line Ls11, the transistors T1 of the pixels 11_11 to **11_*ml*** are put off.

The control unit 15 and controls the switches 131-1 to **131-*m* so that the data lines Ld1 to Ldm and the buffer units 132-1 to 132-*m*** are connected.

At the pixel 11_11, voltage writing to an extent where current flows across the drains and sources of the transistors T3 is carried out across the gates and sources of the transistors T3. This means that the gate voltage Vgs due to the write voltage is retained at the capacitor C1 as a result of voltage writing where the voltage across the gates and sources of the transistors T3 exceeds the threshold value even when the transistors T1 are off.

This means that the gate voltage Vgs of the transistor T3 for the pixel 11_11 does not change. The transistor T3 therefore operates on a fixed operation line for the gate voltage Vgs as shown by the operating point P1 of FIG. 6 and therefore operates within an unsaturated region.

On the other hand, at the pixels 11_21 to 11_ml, writing is carried out across the gates and sources of the transistor T3 to an extent that current does not flow across the drains and sources of the transistors T3. The voltages across the gates and sources of the transistors T3 therefore do not exceed the threshold value. This means that the transistors T3 are off regardless of whether the transistors T1 are on or off. Currents are therefore not supplied from the current supplying circuit 121 to each of the organic EL elements 111 of the pixels 11_21 to 11_ml.

Current supplied from the current supplying circuit 121 therefore only flows to the organic EL element 111 of the pixel 11_ij and flows to the earth line 112 via the organic EL element 111.

At this time, the A/D converter 133-1 of the data driver 13 measures the voltage VEL of the organic EL element 111 via the transistor T2, the data line Ld1, the switch 131-1, and the buffer 132-1.

The light-emitting efficiency extraction unit 136-1 of the correction circuit 134-1 converts the voltage VEL measured by the A/D converter 133-1 to a light-emitting efficiency η for storage in the memory 137-1.

After the light-emitting efficiency extraction unit 136-1 stores the light-emitting efficiency η in the memory 137-1, the control unit 15 controls the first select driver 14, the second select driver 16, and the data driver 13 so as to carry out voltage writing to an extent where current flows across the drain some sources of the transistors T3 to the gates-sources of the respective transistors T3 in order for the pixels 11_21, . . . , **11_*ml* and measure each of the voltages VEL. Next, writing of each of the voltages and measuring of each of the voltages VEL is carried out sequentially for each of the pixels 11_*ij* for each row in the order of the second row to the nth row. In this way, writing of voltages of an extent to where current flows across the drains and sources of the transistors T3 is carried out across the gates and sources of the transistors T3 for all of the pixels 11_*ij*** and the respective voltages VEL are sequentially measured.

The display device measures the voltages VEL of the organic EL elements 111 for all of the pixels **11_*ij***.

When the image data is supplied, as in the first embodiment, the display device corrects the current values based on the measured voltages VEL and writes the drive data Vdata across the gates and sources of the transistors T3 for each pixel 11_11 to **11_*ml*. The display device then causes light to be emitted at the organic EL elements 111 of each of the pixels 11_*ij***.

As described above, according to this embodiment, the transistors T1 and T2 for each of the pixels **11_*ij* are individually controlled to go on and off after writing voltages of values bringing about states where currents flow selectively across the drains and sources of the transistors T3 using the first select driver 14 and the second select driver 16 and after writing voltages of values bringing about states where currents do not flow across the drains and sources of the transistors T3. The voltages VEL of the organic EL elements 111 of each of the pixels 11**_*ij* are then measured.

It is therefore possible to measure the voltages VEL of the organic EL elements 111 every pixel. It is therefore possible to accurately measure the voltage VEL every pixel even in cases where the voltage VEL is different to every pixel as the result of displaying for a long time such as with an indicator for a digital camera.

Fourth Embodiment

A display device of a fourth embodiment measures the voltage of each organic EL element every pixel as in the third embodiment but uses a different configuration to that of the third embodiment.

Figure 13:
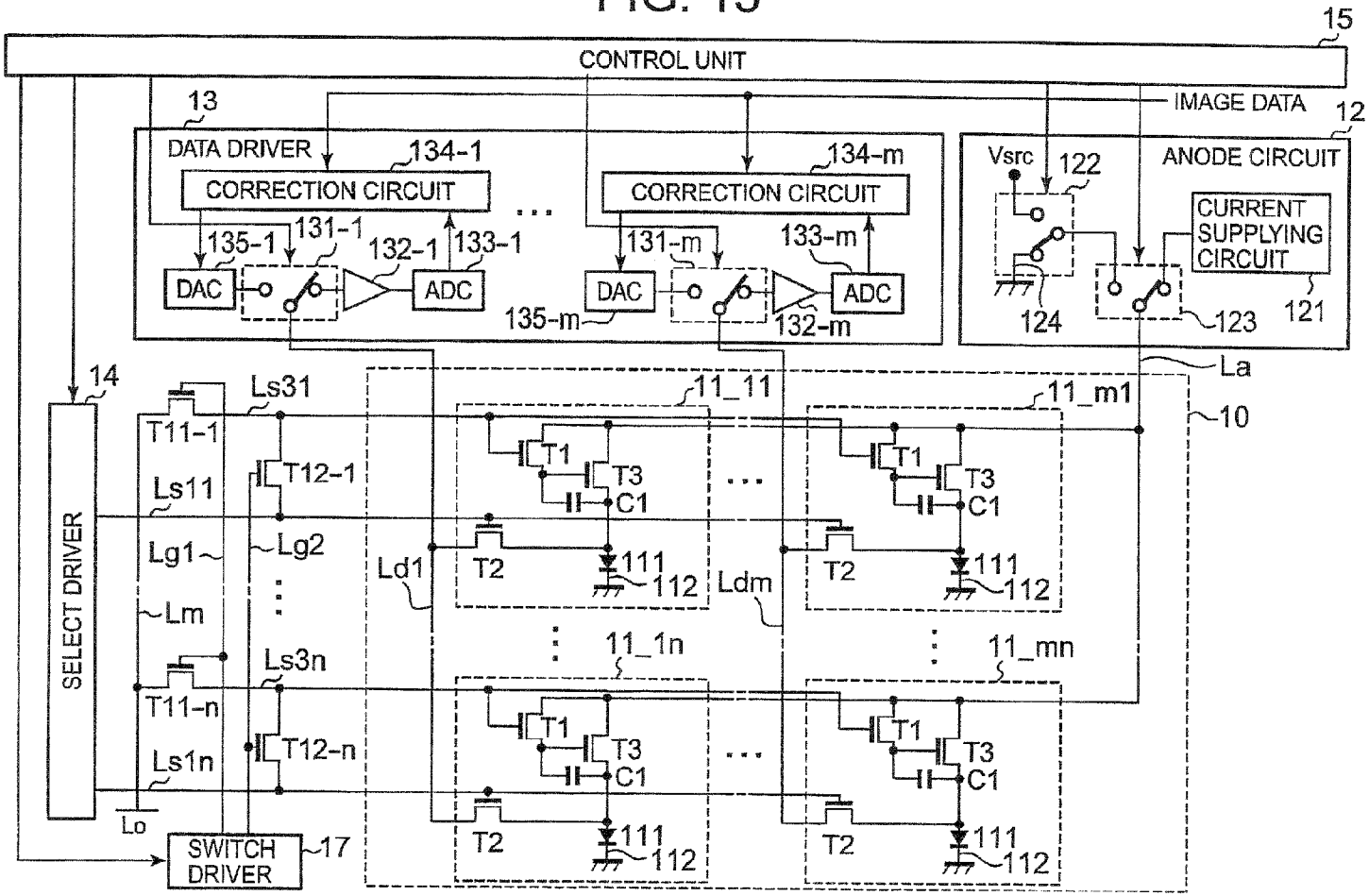
FIG. 13 is a diagram showing a configuration for a display device of a fourth embodiment of the present invention.

A configuration for a display device of the fourth embodiment is shown in FIG. 13.

In addition to the select driver 14 (first select driver unit) of the same configuration as for the first embodiment, the display device of the fourth embodiment includes a second select driver unit of transistors T11-T1 to 11-*n* (first switching element), transistors T12-1 to T12-*n* (second switching element), a gate line Lg1 (first control signal line), a gate line Lg2 (second control signal line), and a switch driver (switch driver circuit) 17.

The transistors T11-1 to T11-*n* are transistors for connecting and disconnecting the select lines Ls31 to Ls3*n* and a low-level line Lm. A low-level voltage is applied to the low-level line Lm. The transistors T11-1 to T11-*n* are TFTs constructed from channel type FETs.

The drains of the transistors T11-1 to T11-*n* are connected to the select lines Ls31 to Ls3*n* and the sources are connected to the low-level line Lm. The gates of the transistors T11-1 to T11-*n* are connected in common to the gate line Lg1.

The transistors T12-1 to T12-*n* are transistors for connecting and disconnecting the select lines Ls11 and Ls31, . . . , Ls1*n* and Ls3*n*. The transistors T12-1 to T12-*n* are TFTs constructed from n-channel type FETs.

The drains of the transistors T12-1 to T12-*n* are connected to the select lines Ls31 to Ls3*n* and the sources are connected to the select lines Ls11 to Ls1*n*. The gates of the transistors T12-1 to T12-*n* are connected in common to the gate line Lg2.

The switch driver 17 is controlled by the control unit 15 so as to output on (High) level or off (Lo) level signals to the gate lines Lg1 and Lg2.

Next, an explanation is given of the operation of the display device of the fourth embodiment.

The display device carries out writing of a voltage of a voltage value that brings about a state where a current flows across the drain and source of the transistor T3 across the gate and source of the transistor T3 only for one of the pixels 11_*ij* of the selected row. The display device then measures the voltage VEL of the organic EL element 111 with respect to the pixel 11_*ij* for which this voltage writing is carried out.

Figure 14:
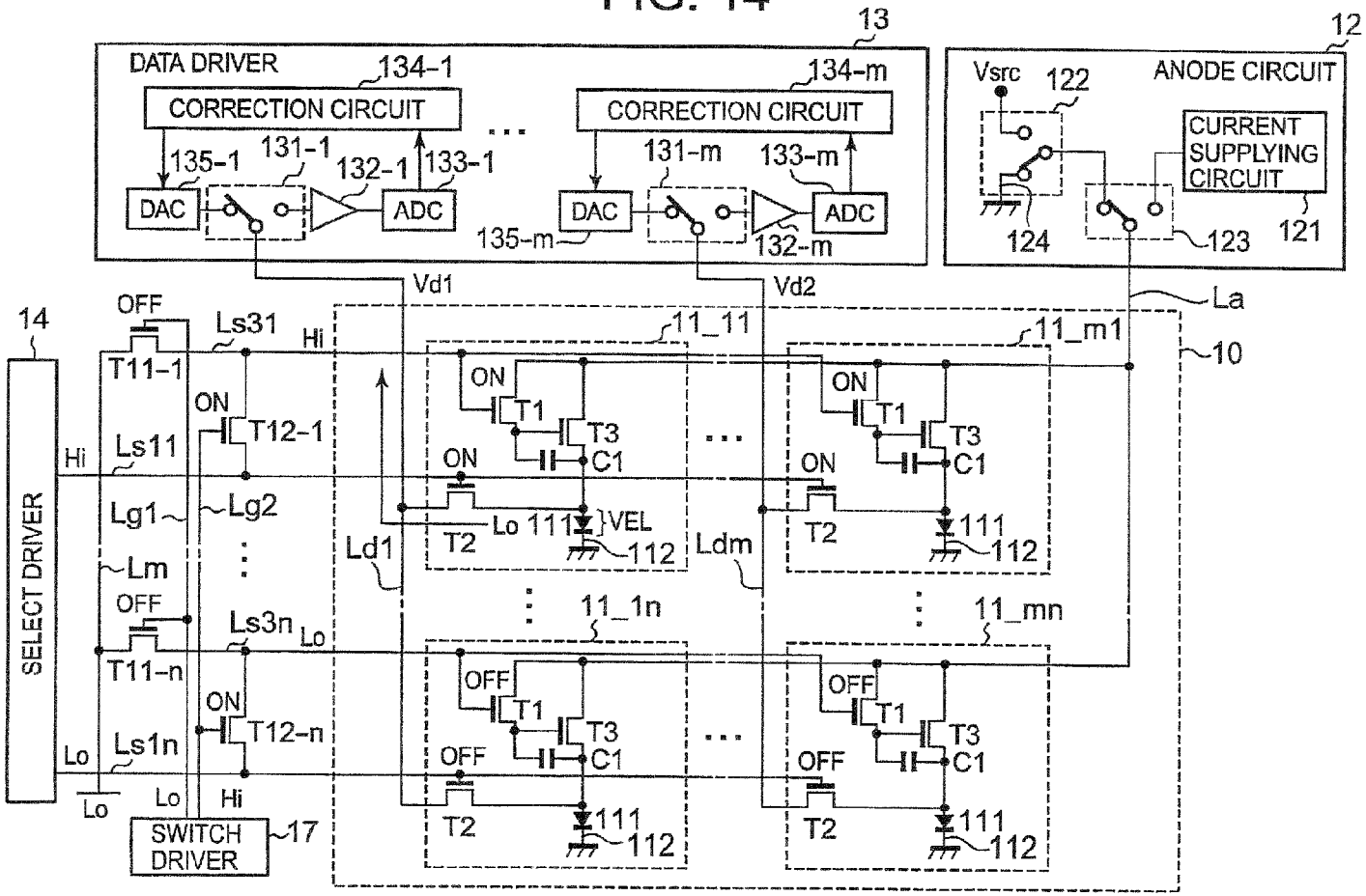
FIG. 14 is a diagram showing a voltage write operation for measuring a voltage of an organic EL element every pixel at the display device shown in FIG. 13.

As shown in FIG. 14, in the operation for writing a voltage to the pixel 11_*ij*, the control unit 15 controls the switches 122 and 123 of the anode circuit 12 so that the anode line La becomes earth potential.

The control unit 15 then exerts control so that the select driver 14 outputs an on level signal to the select line Ls11 and outputs an off level signal to the select lines Ls12 to Ls1*n* so as to select the pixels 11_11 to 11_*ml*.

The control unit 15 then controls the switch driver 17 so that off (Lo) level and on (Hi) level signals are outputted to the gate lines Lg1 and Lg2.

When the switch driver 17 outputs an off level signal to the gate line Lg1, the transistors T11-1 to T11-*n* are put off and the select lines Ls31 to Ls3*n* and the low-level line Lm are disconnected.

When the switch driver 17 outputs an on level signal to the gate line Lg2, the select lines Ls11 and Ls31, . . . , and the select lines Ls1*n* and Ls3*n* are connected.

When the select driver 14 outputs an off level signal to the select lines Ls12 to Ls1*n*, the transistors T2 for each of the pixels 11_12 to 11_*m*2, 11_1*n* to 11_*mn* are put off.

At this time, the transistors T1 of each of the pixels 11_12 to 11_*m*2, . . . , 11_1*n* to 11_*mn* are off because the select lines Ls11 and Ls31 are connected.

When the transistors T1 and T2 for each of the pixels 11_12 to 11_m2, . . . , 11_1*n* to 11_mn are put off, current does not flow from the current supplying circuit 121 to each of the pixels 11_12 to 11_m2, . . . , 11_1*n* to 11_mn.

On the other hand, when the select driver 14 outputs an on level signal to the select line Ls11, the transistors T2 of each of the pixels 11_11 to 11_*ml* are put on.

The transistors T1 for each of the pixels 11_11 to 11_*ml* are also no because the select lines Ls11 and Ls31 are connected.

The D/A converter 135-1 sets a drive signal Vd1 that is a first write voltage having a voltage value that brings about a state where current flows across the drain and source of the transistor T3 that is applied across the gate and source of the transistor T3 of the pixel 11_11 and outputs the drive signal Vd1 that is the first write voltage when the transistors T1 and T2 of each of the pixels 11_11 to 11_*ml* are on.

The value the first voltage is set to a value where the value of current flowing in the pixel 11_11 at the time of writing of the drive signal Vd1 that is the first write voltage becomes a larger current value than the current (initial current Iel_0) supplied from the anode circuit 12 while measuring the voltage VEL thereafter.

On the other hand, the D/A converters 135-2 to 135-*m* set a drive signal Vd2 that is a second write voltage having a voltage value that brings about a state where current does not flow across the drain and source of the transistor T3 applied across the gates and sources of the transistors T3 of the pixels 11_21 to 11_*ml*. When the transistors T1 and T2 of each of the pixels 11_11 to 11_*ml* are on, a drive signal Vd2 that is a second write voltage is outputted to the pixels 11_21 to 11_*ml*. The value of the second voltage is, for example, 0 V.

The control unit 15 controls the switches 131-1 to 131-*m* so as to connect the data lines Ld1 to Ldm and the D/A converters 135-1 to 135-*m* of the data driver 13.

When the data lines Ld1 to Ldm and the D/A converters 135-1 to 135-*m* of the data driver 13 are connected, the transistor T3 of the pixel 11_11 is on. A current therefore flows from the earth line 124 of the anode circuit 12 to the D/A converter 135-1 via the anode line La, and the transistor T3, the transistor T2, and the data line Ld1 of the pixel 11_11. However, the current does not flow to the organic EL element 111 of the pixel 11_11 because the anode of the organic EL element 111 is a negative potential.

A current also does not flow at the data lines Ld2 to Ldm because the transistors T3 of the pixels 11_21 to 11_*ml* are off. A current also does not flow at the organic EL elements 111 of the pixels 11_21 to 11_*ml* because the anodes of the organic EL elements 111 are at earth potential or at negative potential.

The transistor T3 of the pixel 11 is connected as a diode because the transistor T1 is on. The transistor T3 therefore operates within the saturation region and the operating point of this transistor T3 is the operating point P2 of FIG. 6.

Writing of a voltage exceeding the threshold value is carried out across the gate and source of the transistor T3 of the pixel 11_11 of the first row, and writing of a voltage that does not exceed their threshold value is carried out across the gates and sources of the transistors T3 of the pixels 11_21 to 11_*ml*.

Figure 15:
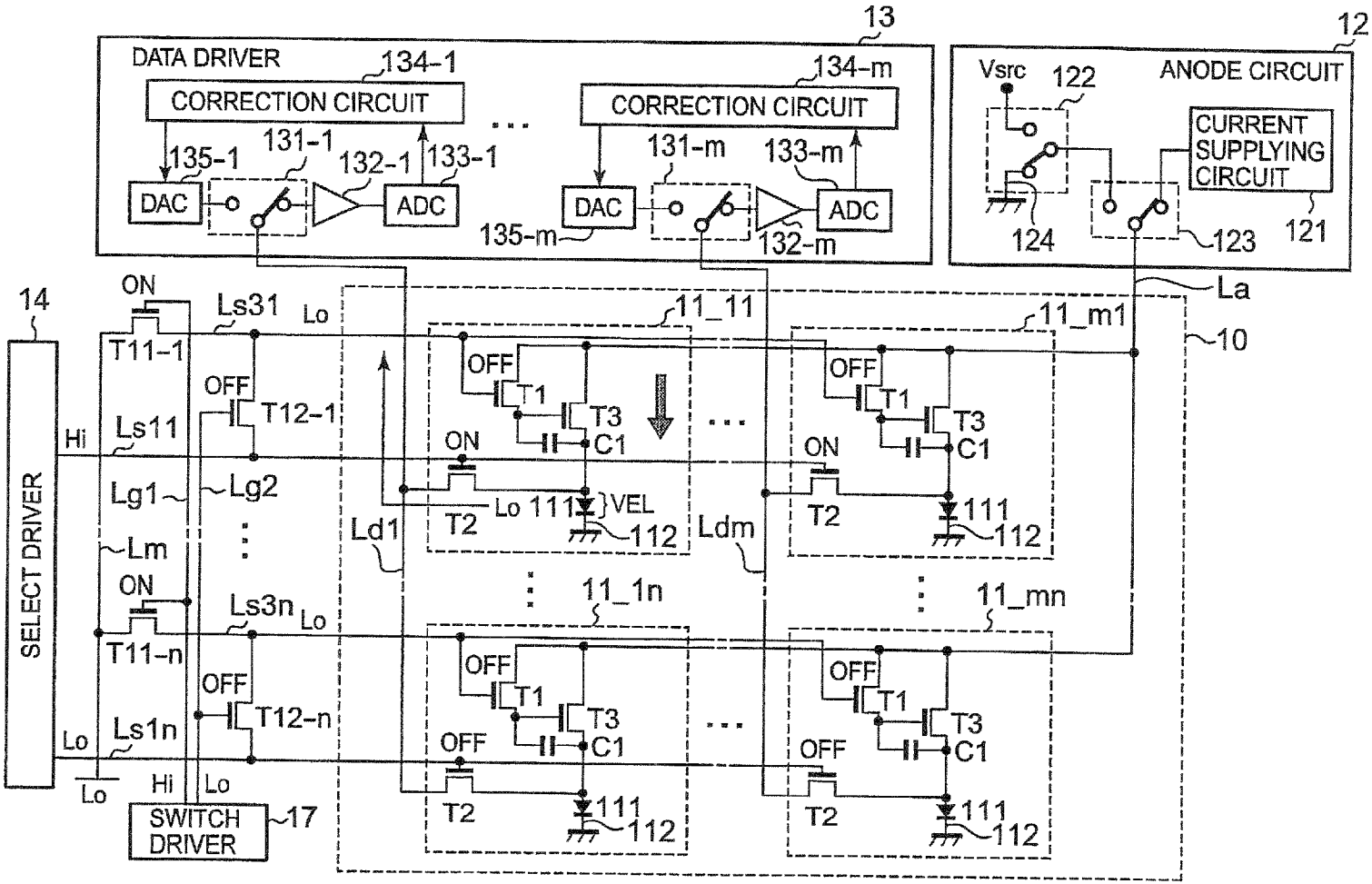
FIG. 15 is a diagram showing an operation for measuring a voltage of an organic EL element every pixel at the display device shown in FIG. 13.

Next, after carrying out the voltage writing described above in the operation for measuring the voltage VEL of the pixel 11_11, the control unit 15 controls the switch 123 so that a current is supplied from the current supplying circuit 121 to the anode line La, as shown in FIG. 15. The value of the current supplied by the current supplying circuit 121 is set to be a current value equal to the initial current Iel_0.

The control unit 15 controls the switch driver 17 so that an on level signal is outputted to the gate line Lg1 and an off level signal is outputted to the gate line Lg2.

Next, the control unit 15 controls the select driver 14 so that an on level signal continues to be outputted to the select line Ls11 and an off level signal is outputted to the select lines Ls12 to Ls1*n*.

When the switch driver 17 outputs an on level signal to the gate line Lg1, the transistors T11-1 to T11-*n* are put on and the select lines Ls31 to Ls3*n* and the low-level line Lm are connected.

When the switch driver 17 outputs an off level signal to the gate line Lg2, the transistors T12-1 to T12-*n* are put off and the select lines Ls11 to Ls1*n* and the select lines Ls31 to Ls3*n* are disconnected.

The signal levels of a select lines Ls31 to Ls3*n* are off levels and each of the transistors T1 of the pixels 11_11 to 11_*ml* of the first row are put off.

On the other hand, each of the transistors T2 of the pixels 11_11 to 11_*ml* remain on.

The transistors T1 and T2 of each of the pixels 11_*ij* are controlled individually to go on and off as in the third embodiment.

The current supplied from the current supplying circuit 121 therefore only flows to the organic EL element 111 of the pixel 11_11 and flows to the earth line 112 via the organic EL element 111 as in the third embodiment.

The control unit 15 and controls the switches 131-1 to 131-*m* so that the data lines Ld1 to Ldm and the buffer units 132-1 to 132-*m* are connected.

The A/D converter 133-1 of the data driver 13 measures the voltage VEL of the organic EL element 111 via the data line Ld1, the switch 131-1, and the buffer 132-1. The light-emitting efficiency extraction unit 136-1 of the correction circuit 134-1 extracts a light-emitting efficiency η corresponding to the voltage VEL measured by the A/D converter 133-1 and stores the light-emitting efficiency η in the memory 137-1.

After the light-emitting efficiency extraction unit 136-1 stores the light-emitting efficiency η in the memory 137-1, the control unit 15 controls the select driver 14, the switch driver 17, and the data driver 13 so as to carry out writing of voltages of voltage values that enable a state where a current flows across the drains and sources of the transistors T3 across the gates and sources of the transistors T3 sequentially for the pixels 11_21, . . . , 11_*ml* and measures each of the voltages VEL. Next, writing of each of the voltages for each of the pixels 11_*ij* for each row and measurement of each of the voltages VEL is carried out in order in the order of the second row to the nth row. In this way, writing of voltages of an extent to where current flows across the drains and sources of the transistors T3 is carried out across the gates and sources of the transistors T3 for all of the pixels 11_*ij* and the respective voltages VEL are measured.

The display device measures the voltages VEL of the organic EL elements 111 for all of the pixels 11_*ij*. When the image data is then supplied, the current value is then corrected based on the measured voltage VEL as in the first embodiment.

The display device writes drive data Vdata across the gates and sources of the transistors T3 of each of the pixels 11_11 to 11_*ml* and causes light of the emitted from the organic EL elements 111 of each of the pixels 11_*ij*.

According to this embodiment, controller is exerted so as to connect and disconnect the select lines Ls1 to Ls1*n* and the select lines Ls31 to Ls3*n* using the transistors T12-1 to T12-*n*, and supply an off level signal to the select lines Ls31 to Ls3*n* using the transistors T12-1 to T12-*n*.

In this embodiment also, as in the third embodiment, control is exerted so as to put the transistors T1 and T2 of each of the pixels 11_*ij* on and off individually and it is possible to measure the voltages VEL of the organic EL elements 111 every pixel. It is therefore possible to accurately measure the voltage VEL every pixel even in cases where the voltage VEL is different every pixel.

Various forms can be considered for implementing the present invention and the present invention is by no means limited to the aforementioned embodiments.

For example, in the above embodiments, an explanation is given taking an organic EL element as a light-emitting element. However, the light-emitting element is not limited to being an organic EL element, and can, for example, also be an inorganic EL element or an LED.

In the above embodiment, high impedance buffer units 132-1 to 132-*m* are provided at the data driver 13 in order to prevent the flow of current. However, it is also possible to not provide the buffer units 132-1 to 132-*m* providing that the A/D converters 133-1 to 133-*m* are high impedance.

The relationship between the light-emitting efficiency of the organic EL element and the voltage shown in FIG. 2 changes depending on the light emitting material of the organic EL element and is by no means limited to that described. The LUT shown in FIG. 3 is similarly also not limited to that shown.

In each of the above embodiments, an explanation is given of the case of application of the present invention to a display device having a light-emitting region where a plurality of pixels having the light-emitting elements are arranged in a matrix but the present invention is by no means limited in this respect. For example, application is also possible to a light-emitting device having a light emitting element where a plurality of pixels having light-emitting elements are arranged in one direction and irradiate light emitted according to image data at a photosensitive drum to bring about exposure at an exposure device.

Fifth Embodiment

The following is an explanation with reference to the drawings of a light-emitting device of a fifth embodiment of the present invention.

Figure 16:
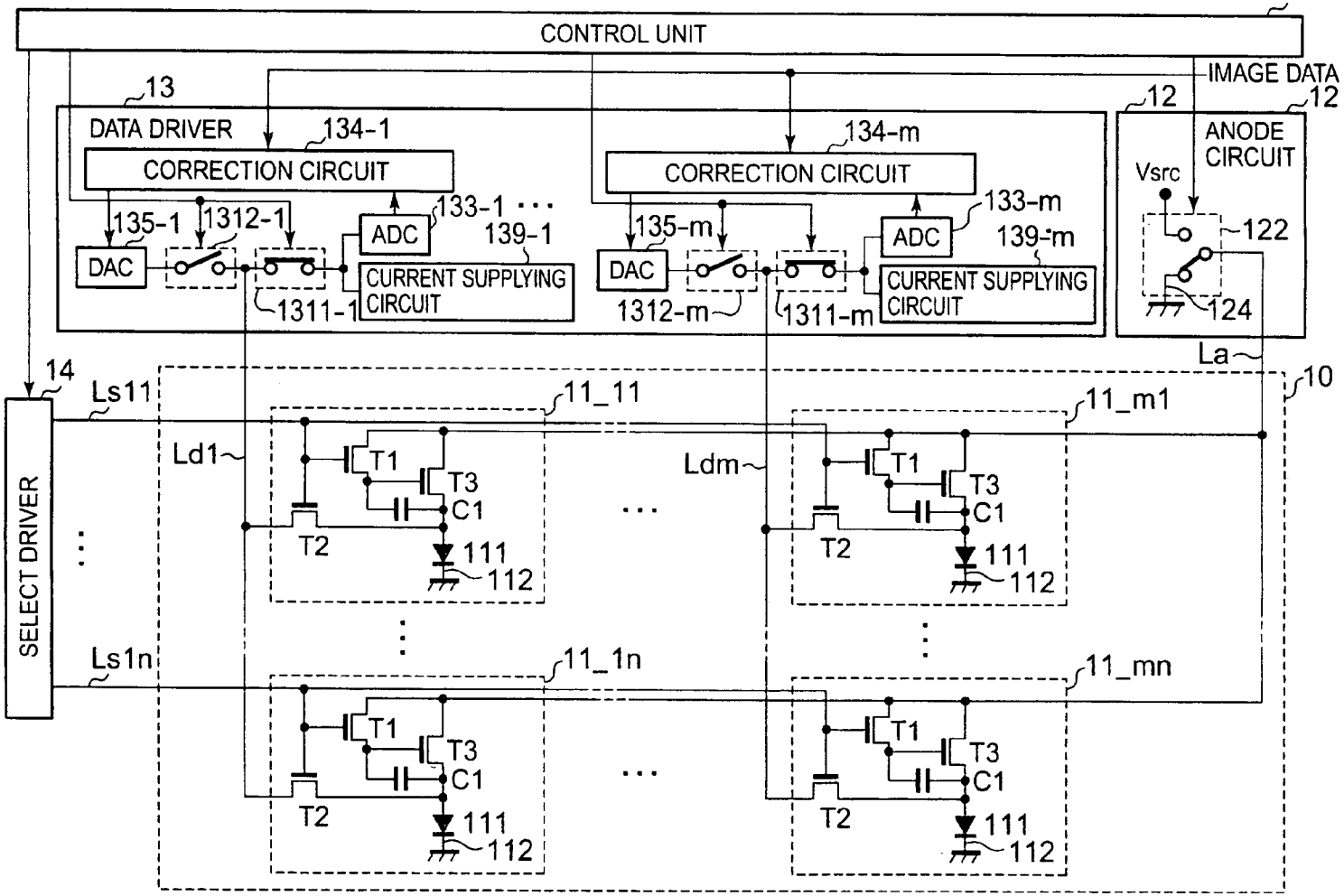
FIG. 16 is a block diagram showing a configuration for a light-emitting device of a fifth embodiment of the present invention.

A configuration for a light-emitting device of this embodiment is shown in FIG. 16.

The light-emitting device of this embodiment includes a plurality of pixels 11_*ij* (i=1 to m, j=1 to n, m, n; natural numbers), the light-emitting region 10 where the plurality of pixels 11_*ij* are arranged, the anode circuit 12, the data driver (data driving unit) 13, the select driver (select driver unit) 14, and the control unit 15.

Each pixel 11_*ij* corresponds to one pixel of an image and the pixels are arranged in rows and columns. Each pixel 11_*ij* includes an organic EL element 111, transistors T1 to T3, and a capacitor (voltage holding unit) C1.

The organic EL (Organic Elector-Luminescence) element 111 is a light-emitting element that utilizes a phenomenon where light is emitted by the occurrence of excitons that occur as the result of recombination of electrons injected into the organic material with positive holes. Light is then generated at a brightness corresponding to a current value of a supplied current.

A pixel electrode is formed at the organic EL element 111 and a positive hole injection layer, a light emitting layer, and an opposing electrode are formed on the pixel electrode (none of which are shown in the drawings). The positive hole injection layer is formed on the pixel electrodes and has a function for providing positive holes to the light-emitting layer.

The pixel electrodes are made from a conductive material having transparency such as, for example, ITO (Indium Tin Oxide), or Zn, etc. Each pixel electrode is insulated from pixel electrodes for other neighboring pixels by an inter-layer insulating film (not shown).

The positive hole injection layer is made from an organic copolymer material capable of being injected with and carrying positive holes (holes). An aqueous solution of PEDOT/PSS that is a dispersion fluid where, for example, a conductive polymer of polyethylenedioxythiophene (PEDOT) and a dopant of polystyrene sulphonic acid (PSS) are dispersed in a water-based solvent can be used as the organic compound-containing liquid including organic polymer hole injection/carrier material.

The light-emitting layer is formed on an interlayer (not shown). The light-emitting layer has a function for generating light as the result of the application of a voltage across the anode electrodes and the cathode electrodes.

The light-emitting layer can be constructed from a well-known high-polymer material that is capable of being fluorescent or phosphorescent such as red (R), green (G), and blue (B) light-emitting material including a conjugated double-bond polymer such as, for example, polyparaphenylene vinylene, or polyfluorine etc.

Further, it is also possible for the light-emitting materials to be formed by applying a fluid (dispersion fluid) dissolved (or dispersed) in an appropriate water-based solvent or an organic solvent such as tetrahydronaphthalene, tetramethylbenzene, mesitylene, or xylene. The solvent is then volatized.

In the case of three colors, the light emitting material for R, G and B for the organic EL element 111 this normally applied every column.

The opposing electrodes have a two-layer structure of a layer of a conductive material that is a material of a low work function such as, for example, Ca, Ba, and a light-reflecting conductive film such as Al and are connected to the earth line 112.

A current flows from the pixel electrode to the opposing electrode but does not flow in the opposite direction. The pixel electrode and the opposing electrode therefore constitute an anode electrode and a cathode electrode.

Characteristics of the organic EL element 111 gradually deteriorate as the result of supplying current for driving over a long period of time. Namely, when the characteristics of the organic EL element 111 deteriorate, resistance increases, and it becomes difficult for a current to flow. This means that the brightness of the emitted light falls with respect to the current flowing and the light-emitting efficiency therefore falls.

This is to say that when the characteristics of the organic EL element 111 deteriorate, it is necessary to increase the current provided to the organic EL element 111 in order to obtain the initial brightness. When the current is increased, a voltage VEL across the cathode and anode of the organic EL element 111 also increases.

There is a correlation between the brightness and the voltage VEL across the cathode and anode of the organic EL element 111. FIG. 2 shows the relationship between light-emitting efficiency η and the voltage VEL. The light-emitting efficiency η is a parameter indicating change in brightness taking an initial brightness (value) when the organic EL element 111 as its initial characteristics when a fixed current (verification current of an initial current value of Iel_0) flows at the organic EL element 111. FIG. 2 therefore shows to what extent the voltage VEL changes when the light-emitting efficiency η changes according to drive time.

This relationship is data acquired by experimentation and is data for when an initial current Iel_0 giving a brightness of 5000 cd/$m^2$ and a brightness per unit area of 16 cd/A flows when the organic EL element 111 has its initial characteristics. Current for the initial current Iel_0 is 5000×(100×300)/16=9.38 (μA) when a surface area of a light emitting unit is taken to be 100 μm×300 μm.

The display device of this embodiment obtains the brightness of the supplied image data taking note of the relationship between the light-emitting efficiency η and the voltage VEL by measuring the voltage (verification voltage) VEL when the initial current Iel_0 flows at the organic EL element 111 and correcting the provided current based on this voltage VEL.

The transistors T1 to T3 are TFTs (Thin-Film Transistors) constituted by n-channel FETs (Field Effect Transistors) such as, for example, amorphous silicon or polysilicon TFTs.

The transistor T1 (write control transistor) is a switching transistor for turning the transistor T3 (current control transistor) on and off.

A drain (terminal) for the transistor T1 for each pixel 11_*ij* is connected to an anode line (power supply line) La.

The gates (terminals) of the transistors T1 for each pixel 11_11 to 11_*ml* are connected to the select line Ls11. Similarly, the gates of the transistors T1 for each pixel 11_12 to 11_*m*2 are connected to the select lines Ls12, . . . , and the gates of the transistors T1 of each of the pixels 11_1*n* to 11_*mn* are connected to the select line Ls1*n*.

In the case of the pixel 11_11, when an on (High) level signal is outputted from the select driver 14 to the select line Ls11, the transistor T1 is put on and the transistor T3 is also put on.

When an off (Low) level signal is outputted to the select line Ls11, the transistors T1 are put off, and the transistors T3 are also put off. When this happens, when the transistors T1 are put off, charge charged at the capacitors C11 is retained.

The transistor T2 (select control transistor) is a switch transistor that is selected by the select driver 14 to go on and off, and a switch transistor for connecting and disconnecting the anode circuit 12 and the data driver 13.

A drain that is one end of the transistor T2 of each pixel 11_*ij* is connected to an anode (electrode) of the organic EL element 111.

A gate (terminal) of the transistor T2 for each pixel 11_11 to 11_ml is connected to the select line Ls11. Similarly, the gates of the transistors T2 for each pixel 11_12 to 11_m2 is connected to the select line Ls12, . . . , and the gates of the transistors T2 for each of the pixels 11_*n* to 11_mn are connected to the select line Ls1*n*.

A source that is the other end of the transistor T2 for each of the pixels 11_11 to 11_In is connected to the data line Ld1. Similarly, the sources of the transistors T2 of each of the pixels 11_21 to 11_2*n* are connected to the data line Ld2, . . .

and the sources of the transistors T2 for each of the pixels 11_*ml* to 11_*mn* are connected to the data line Ldm.

In the case of pixel 11_11, when an on level signal is outputted to the select line Ls11 the transistor T2 from the select driver 14, the transistor T2 goes on, and the anode of the organic EL element 111 and the data line Ld1 are connected.

When an off level signal is outputted to the select line Ls11, the transistor T2 goes off, and the anode of the organic EL element 111 and the data line Ld1 are disconnected.

The capacitor C1 is a capacitor that holds a voltage Vgs (hereinafter referred to as "gate voltage Vgs") across the gate and source of the transistor T3. One end of the capacitor C1 is connected to the source of the transistor T1 and the gate of the transistor T3, and the other end is connected to the source of the transistor T3 and the anode of the organic EL element 111.

When the transistor T1 is put on, the gate and drain of the transistor T3 are connected so as to be connected like a diode and be on. When a current then flows from the anode line La towards the drain of the transistor T2, the transistor t3 goes on, the capacitor C1 is charged up by the gate voltage Vgs of the corresponding transistor T3 and this charge is accumulated.

The capacitor C1 then holds the gate voltage Vgs of the transistor T3 when the transistors T1 and T2 are put off.

The anode circuit 12 puts the anode line La to, for example, earth potential when measuring the voltage VEL and when writing the drive signal to each of the pixels 11_*ij*, and sets the anode line La to a prescribed voltage (voltage Vsrc) when each of the pixels 11_*ij* are made to emit light in accordance with the image data. The anode circuit 12 includes the switch circuit 122 and a constant voltage source that outputs the voltage Vrc.

The switch 122 is switched over between being connected to the voltage Vsrc being connected across the earth line 124 and the anode line La. This voltage Vsrc is set to be in the order of, for example, 12 V.

The data driver 13 is for writing data to the organic EL elements 111 of each of the pixels 11_*ij*. The data driver includes switches 1311-1 to 1311-*m*, current supplying circuits 139-1 to 139-*m*, the A/D converters (ADCs) 133-1 to 133-*m*, the correction circuits 134-1 to 134-*m*, the D/A converters 135-1 to 135-*m*, and switches 1312-1 to 1312-*m*.

The switches 1311-1 to 1311-*m* are for connecting and disconnecting the data lines Ld1 to Ldm, and the input terminals of the current supplying circuits 139-1 to 139-*m* and the input terminals of the A/D converters 133-1 to 133-*m*.

The current supplying circuits 139-1 to 139-*m* supplied a constant current constituting the verification current. The A/D converters 133-1 to 133-*m* are for measuring the analog voltages VEL applied to the data lines Ld11 to Ld1*n* via the switches 1311-1 to 1311-*m* and converting the measured analog voltages VEL to digital voltages VEL. The A/D converters 133-1 to 133-*m* then supply the converted digital voltages VEL to the correction circuits 134-1 to 134-*m*.

The correction circuits 134-1 to 134-*m* are circuits are correct values for drive data Vdata according to the image data based on the voltages VEL supplied by the A/D converters 133-1 to 133-*m* so as to acquire a brightness corresponding to the supplied image data.

Figure 17:
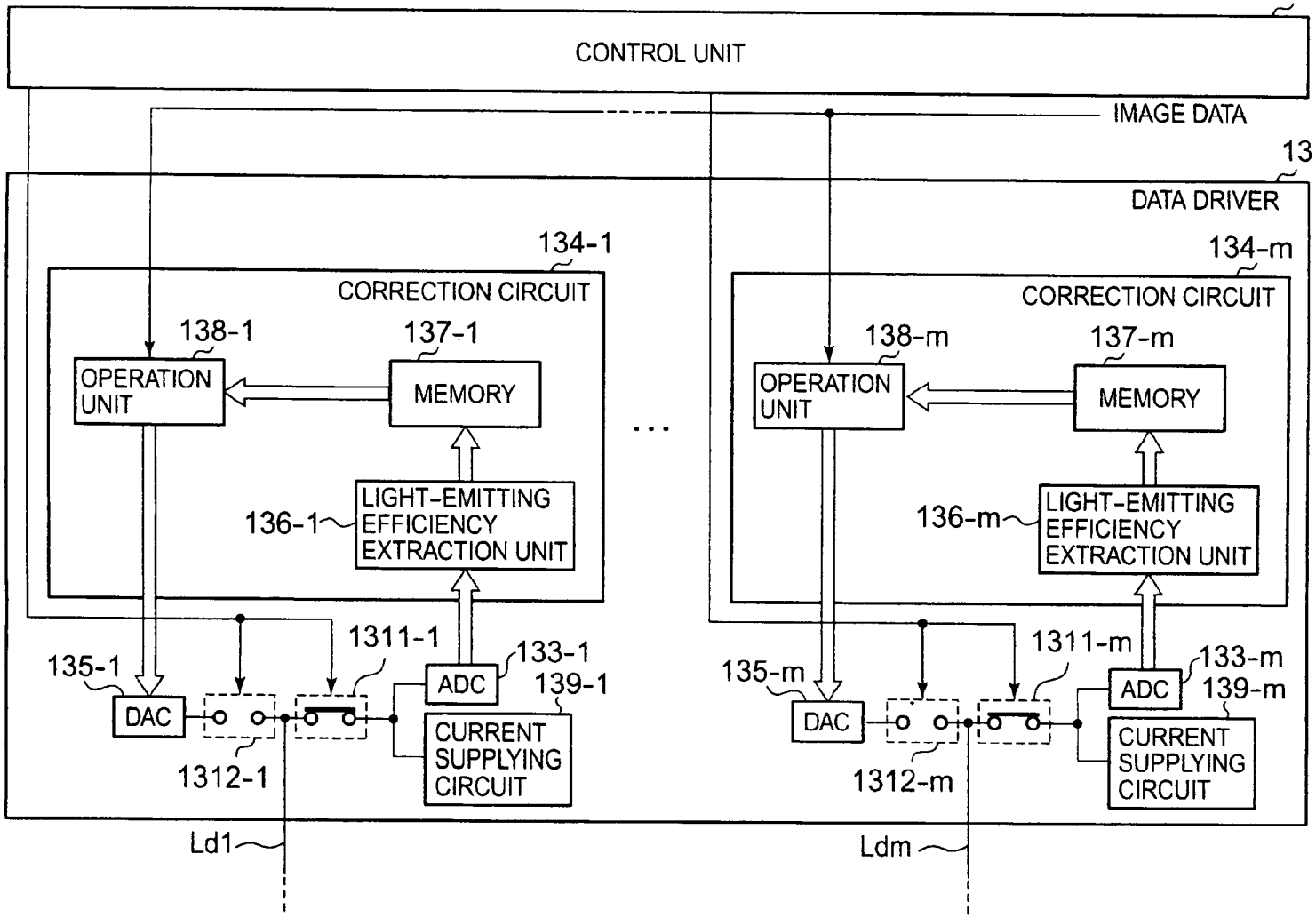
FIG. 17 is a diagram showing a configuration for a correction circuit shown in FIG. 16.

As shown in FIG. 17, the correction circuits 134-1 to 134-*m* include the light-emitting efficiency extraction units 136-1 to 136-*m*, the memories 137-1 to 137-*m*, and the operation units 138-1 to 138-*m*.

The light-emitting efficiency extraction units 136-1 to 136-*m* are for extracting the light-emitting efficiencies η corresponding to the respective voltages VEL acquired through measurement for storage in the LUT (Look Up Table, storage circuit) shown in FIG. 4.

This LUT is a table showing the relationship between the voltage VEL, the brightness, and the light-emitting efficiency η and is made based on the relationship between the light-emitting efficiency η and the voltage VEL shown in FIG. 2.

This LUT shows the relationship between the change in brightness when a current of an initial value Iel_0 flows at the organic EL element 111, and the light-emitting efficiency η and the voltage VEL.

This LUT shows that when a current of the initial value Iel_0 required for obtaining a brightness of 5000 cd/m$^2$ when the organic EL element 111 has the initial characteristics flows so that the brightness is 3000 cd/m$^2$, the light-emitting efficiency becomes η=3000/5000=0.60 and the voltage VEL increases to 8.30 V from an initial value of 7.85 V.

In this embodiment, the LUT supplies one corresponding type of verification current from the current supplying circuits 139-1 to 139-*m* so as to correspond with one initial current Iel_0 (verification current). However, the present invention is by no means limited in this respect, and the LUT can also correlate verification current of a plurality of different values for two or more levels. In this event, verification currents of different values for a plurality of corresponding levels can be supplied from the current supplying circuits 139-1 to 139-*m*. In this case, measurement of the voltage VEL is carried out a plurality of times according to the verification currents for each level.

The light-emitting efficiency extraction units 136-1 to 136-*m* refer to this LUT and extract light-emitting efficiencies η corresponding to the voltages VEL.

The memories 137-1 to 137-*m* are memories (storage circuits) for storing the light-emitting efficiencies η extracted by the light-emitting efficiency extraction units 136-1 to 136-*m*.

The operation units 138-1 to 138-*m* are respectively supplied image data and acquire drive data Vdata in order to acquire brightness corresponding to the image data.

The operation units 138-1 to 138-*m* read out the light-emitting efficiencies η from the memories 137-1 to 137-*m* when writing using the drive data Vdata.

When the organic EL elements 111 have their initial characteristics, the operation units 138-1 to 138-*m* multiplies the current Ie1*f*_0 required in order to acquire a brightness corresponding to the supplied image data and the inverse of the light-emitting efficiency η read from the memory 137-1 so as to acquire a current correction value Ie1*f*_1.

The operation units 138-1 to 138-*m* then acquire the drive data Vdata based on the characteristics of the drain-source current with respect to the gate voltage of the transistors T3 of each of the pixels 11_*ij* and the current correction value Ie1*f*_1.

The D/A converters 135-1 to 135-*m* are for converting digital drive data Vdata obtained by the operation units 138-1 to 138-*m* to an analog write voltage Vd (drive signal: negative voltage).

The D/A converters 135-1 to 135-*m* draw current from the transistors T3 via the transistors T2 by applying the write voltage Vd to the other ends of the transistors T2 of each of the pixels 11_1*j* to 11_mj via the data lines Ld1 to Ldm.

The switches 1312-1 to 1312-*m* are for connecting and disconnecting the data lines Ld1 to Ldm and the output terminals of the D/A converters 135-1 to 135-*m*.

The select driver 14 is for selecting a pixel 11_*ij* every row under the control of the frame control unit 15 and is, for example, a shift register. The select driver 14 outputs on or off level signals to the select lines Ls11 to Ls1*n*.

The control unit 15 is for controlling each unit. The control unit 15 controls each unit so as to acquired the required brightness's by correcting the values of current supplied when writing the drive signal based on fluctuation of the voltage VEL of the organic EL element 111.

As a result, the control unit 15 executes a calibration step and an image displaying step.

The calibration step is a step of measuring the voltages VEL of the organic EL elements 111 of each of the pixels 11_*ij* and extracting the light-emitting efficiencies η corresponding to the measured voltages VEL for the relationship between the voltages VEL and the light-emitting efficiency η shown in FIG. 2 that is measured in advance.

The image displaying step is a step that corrects the current values based on the light-emitting efficiency η when the image data is supplied so as to acquire a brightness corresponding to the supplied image data, writes corresponding drive data Vdata across the gates and sources of each of the pixels 11_*ij* so as to cause each of the organic EL elements 111 to emit light.

The display device measures the voltages VEL, for example, every time the power supply is turned on, every one day, or every fixed time period of usage.

When the voltage VEL is measured, the control unit 15 controls the anode circuit 12, the data driver 13, and the select driver 14 so that a constant current flows from the current supplying circuits 139-1 to 139-*m* via the organic EL elements 111 of each of the pixels 11_*ij* to the earth line 112.

When writing of the drive data Vdata is carried out, the control unit 15 controls the anode circuit 12, the data driver 13, and the select driver 14 so that current doesn't flow from the anode circuit 12 to the organic EL elements 111 of each of the pixels 11_*ij* but does flow at the data driver 13.

When light is emitted at the organic EL elements 111, the control unit 15 controls the anode circuit 12, the data driver 13, and the select driver 14 based on the gate voltages Vgs of each of the transistors T3 of each of the pixels 11_*ij* so that current is supplied to the organic EL elements 111.

Next, an explanation is given of the operation of the light-emitting device of this embodiment.

First, an explanation is given of the operation while measuring the voltages VEL of the organic EL elements 111 of each of the pixels 11_*ij*.

Figure 18:
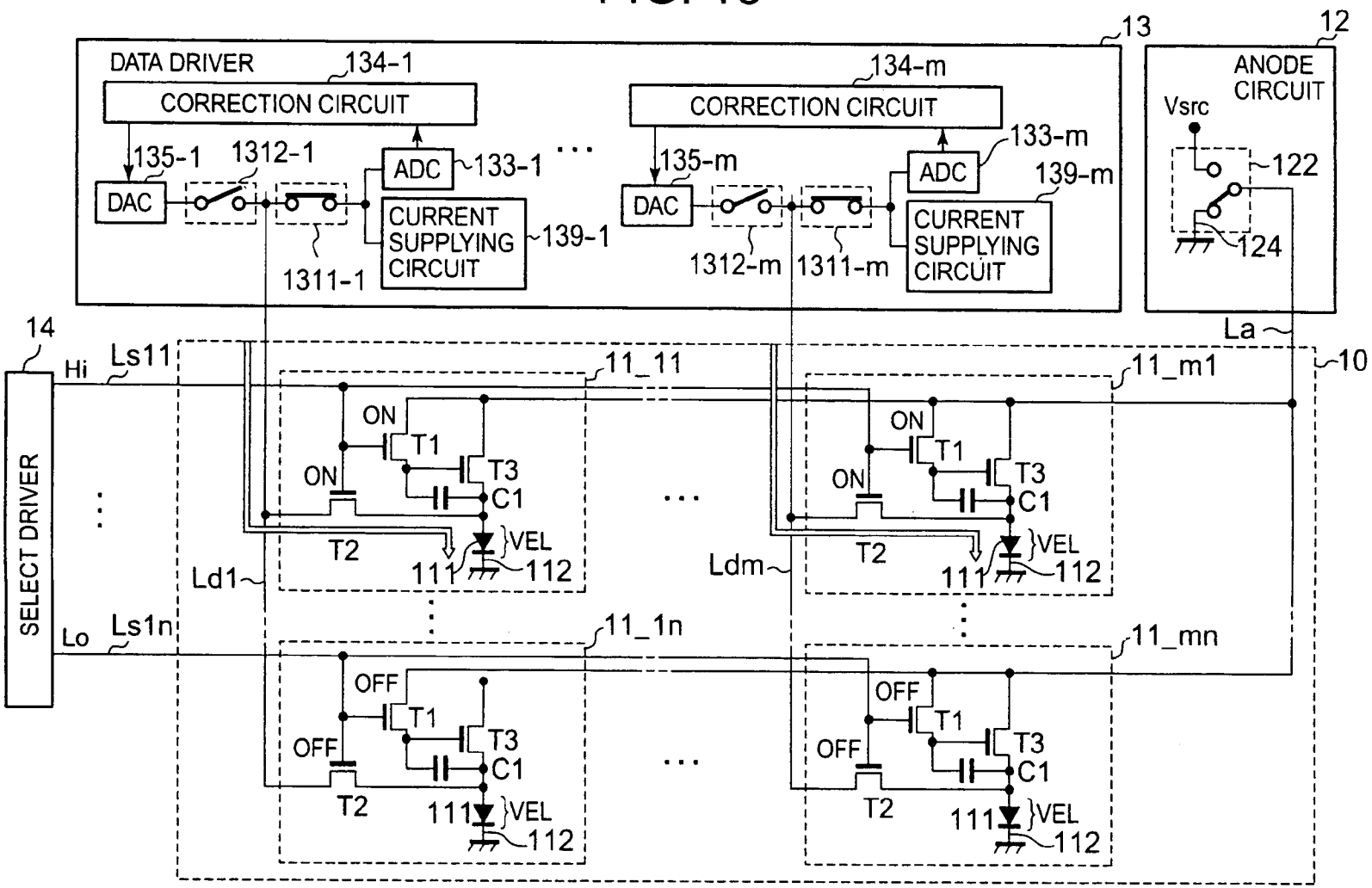
FIG. 18 is a diagram showing a voltage measuring operation for an organic EL element shown in FIG. 16.

The control unit 15 of the light-emitting device controls each unit so as to select each of the pixels 11_*ij* of each row and measure the voltages VEL of each of the organic EL elements 111 of the selected rows. In order to measure the voltages VEL, as shown in FIG. 18, the control unit 15 controls the switch 122 of the anode circuit 12 so as to connect the anode line La and the 124. The anode line La and the cathodes of the organic EL elements 111 therefore become the same potential as a result of the control of the control unit 15.

The control unit 15, for example, selects the pixels 11_11 to 11_*ml* of the first row. In order to select the pixels 11_11 to 11_*ml*, the control unit 15 controls the select driver 14 so as to output an on level signal to the select line Ls11 and output off level signals to the select lines Ls12 to Ls1*n*.

When the select driver 14 outputs an off level signal to Ls12 to Ls1*n*, each of the transistors T1 and T2 of the pixels 11_12 to 11_*m*2, . . . , 11_1*n* to 11_*mn* are put off.

When each of the transistors T1 of the pixels 11_12 to 11_*m*2, . . . , 11_1*n* to 11_*mn* are put off, each of the transistors T3 are also put off. Current therefore does not flow at the pixels 11_12 to 11_*m*2, . . . , 11_1*n* to 11_*mn*.

Further, when each of the transistors T2 of the pixels 11_12 to 11_m2, . . . , 11_1*n* to 11_mn are put off, the pixels 11_12 to 11_m2, . . . , 11_1*n* to 11_mn are disconnected from the data lines Ld1 to Ldm.

When the select driver 14 outputs an on level signal to the select line Ls11, each of the transistors T1 and T1 of the pixels 11_11 to 11_*ml* are put on. When each of the transistors T1 are put on, the gates and drains of each of the transistors T3 are connected as diodes so as to be put on.

The control unit 15 controls the switches 1312-1 to 1312-*m* so as to disconnect the data lines Ld1 to Ldm and the D/A converters 135-1 to 135-*m*.

The control unit 15 controls the switches 1311-1 to 1311-*m* so as to connect the data line Ld1, the current supplying circuit 139-*m* of the data driver 13 and the A/D converters 133-1 . . . , and the data line Ldm and the current supplying circuit 139-1 and the A/D converter 133-*m*.

At the pixels 11_11 to 11_*ml*, the cathodes of each of the organic EL elements 111 are connected to earth, and the anode line La is connected to earth potential.

As a result, when the data line Ld1, the current supplying circuit 139-1, and the A/D converter 133-1 are connected and a constant current is supplied by the current supplying circuit 139-1, the source electrode of the transistor T3 of the pixel 11_11 is at a potential higher than the drain electrode. A current therefore does not flow across the drain and source of the transistor T3. The constant current supplied by the current supplying circuit 139-1 therefore flows from the current supplying circuit 139-1 of the data driver 13 via the data line Ld1, the transistors T2 of each of the pixels 11_11, and the organic EL elements 111 to the earth line 112. The value of the constant current supplied by the current supplying circuit 139-1 can be set to be equal to the initial current Iel_0 (verification current).

Similarly, when the data line Ld2, the current supplying circuit 139-2, and the A/D converter 132-2, . . . , and the data line Ldm, the current supplying circuit 139-*m*, and the A/D converter 133-2 are connected, the constant current flows from the current supplying circuit 139-1 of the data driver 13 via the organic EL elements 111 of each of the pixels 11_11 to 11_ml, to the earth line 112.

The A/D converters 133-1 to 133-*m* of the data driver 13 measure the voltages of the connection points of the drains of the transistors T2 and the anodes of the organic EL elements 111 via each of the transistors T2 of the pixels 11_11 to 11_ml, the data lines Ld1 to Ldm, and the switches 1311-1 to 1311-*m*.

This voltage is the voltage VEL of the organic EL element 111. The A/D converters 133-1 to 133-*m* therefore measure the voltages VEL of the organic EL elements 111.

The on resistance of each of the transistors T2 of each of the pixels 11_11 to 11_ml can be ignored because the gate voltage Vgs is high.

The A/D converters 133-1 to 133-*m* then convert the analog voltages VEL to digital voltages VEL.

The light-emitting efficiency extraction units 136-1 to 136-*m* of the correction circuits 134-1 to 134-*m* refer to the LUT and extract light-emitting efficiencies η corresponding to a digital voltages VEL converted by the A/D converters 133-1 to 133-*m*. The light-emitting efficiency extraction units 136-1 to 136-*m* then store the extracted light-emitting efficiencies η in the memories 137-1 to 137-*m*.

When the light-emitting efficiency extraction units 136-1 to 136-*m* store the extracted light-emitting efficiencies η in the memories 137-1 to 137-*m*, the control unit 15 selects the pixels 11_12 to 11_*m*2 of the second row.

In order to select the pixels 11_12 to 11_*m*2 of the second row, the control unit 15 controls the select driver 14 so as to output an on level signal to a select line Ls12 and output an off level signal to the select lines Ls11, and Ls13 to Ls1*n*.

When the select driver 14 outputs an off level signal to the select lines Ls11 and Ls13 to Ls1*n*, each of the transistors T1 and T2 for the pixels 11_11 to 11_*ml*, 11_13 to 11_*m*3, . . . , and 11_1*n* to 111_*mn* are put off.

When each of the transistors T1 and T2 are put off, current does not flow at the pixels 11_11 to 11_ml, 11_13 to 11_m3, . . . , 11_*n* to 11_mn, and the data lines Ld1 to Ldm are disconnected.

When the select driver 14 outputs an on level signal to the select line Ls12, each of the transistors T1 and T2 of the pixels 11_12 to 11_*m*2 are put on. When the transistor T1 is put on, the transistor T3 is also put on.

The current then flows from the current supplying circuits 139-1 to 139-*m* of the data driver 13, via the data lines Ld1 to Ldm and the transistors T2 of each of the pixels 11_12 to 11_m2 to the organic EL elements 111.

The A/D converters 133-1 to 133-*m* of the data driver 13 measure the voltages VEL of the organic EL elements 111 via each of the transistors T2 of the pixels 11_12 to 11_m2, the data lines Ld1 to Ldm, and the switches 1311- to 1311-*m* and converts the voltages VEL to digital voltages VEL.

The light-emitting efficiency extraction units 136-1 to 136-*m* of the correction circuits 134-1 to 134-*m* refer to the LLT, extract light-emitting efficiencies η corresponding to a digital voltages VEL converted by the A/D converters 133-1 to 133-*m*, and store the extracted light-emitting efficiencies η in the memories 137-1 to 137-*m*.

Similarly, the control unit 15 controls each unit so as to select the pixels 11_13 to 11_*m*3, . . . , 11_1*n* to 11_*mn*, and measure the voltages VEL of the organic EL elements 111 every row.

Next, an explanation is given of the operation while display driving each of the organic EL elements 111 of the pixels 11_*ij* based on the image data.

Figure 19:
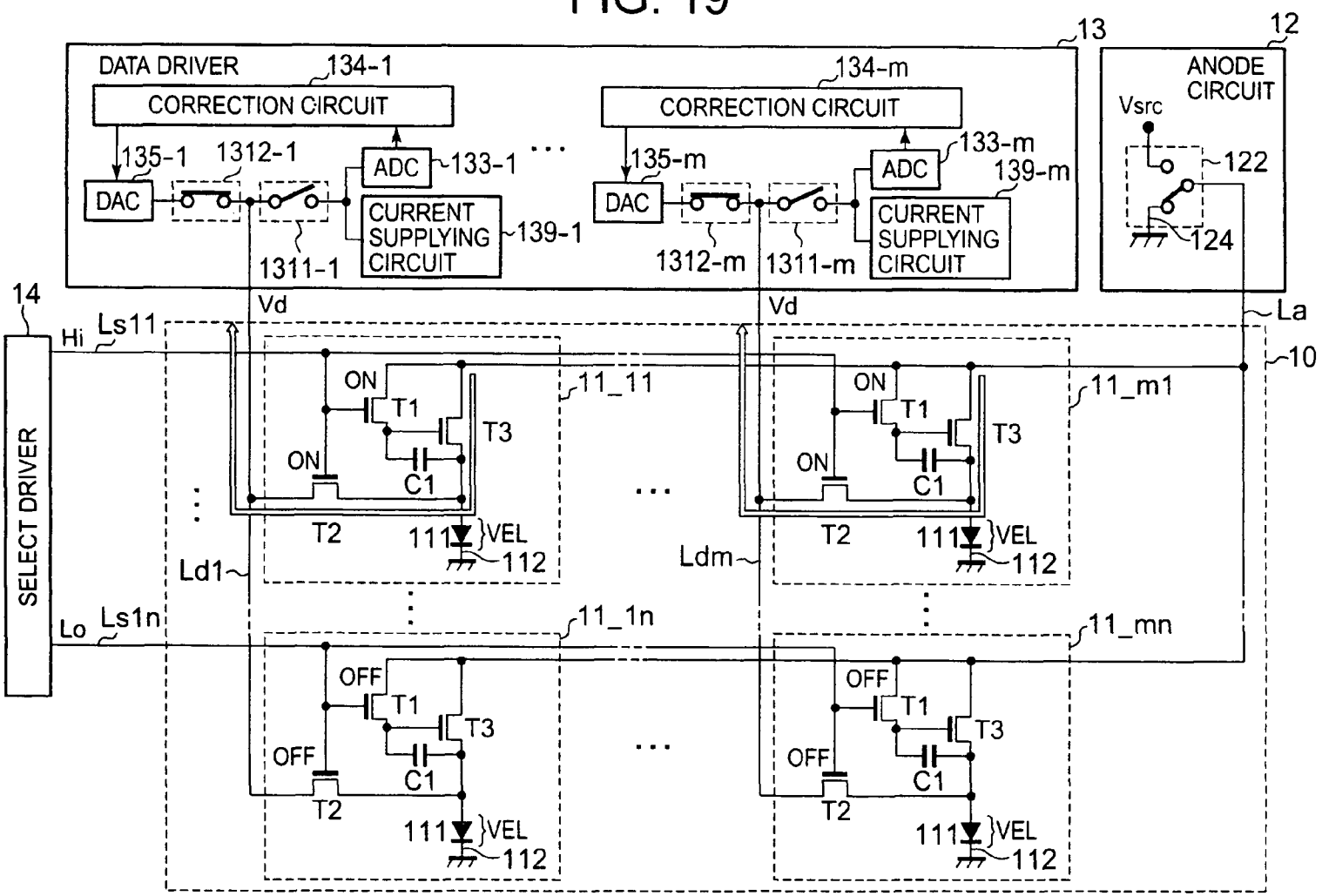
FIG. 19 is a diagram showing a write operation for the light-emitting device shown in FIG. 16.

When the image data is supplied, the light-emitting device writes the drive data Vdata for each of the pixels 11_11 to 11_*mn*. As with the time of measuring the voltages VEL, as shown in FIG. 19, the control unit 15 controls the switch 122 of the anode circuit 12 so as to connect the anode line La and the earth line 124 and put the anode line La at earth potential.

The control unit 15 then controls the switches 1311-1 to 1311-*m* so as to disconnect the data line Ld1 to Ldm, the current supplying circuits 139-1 to 139-*m* of the data driver 13 and the A/D converters 133-1 to 133-*m*.

Next, the control unit 15 selects the pixels 11_11 to 11_*ml* of the first row. In order to select the pixels 11_11 to 11_*ml*, the control unit 15 controls the select driver 14 so as to output an off level signal to the select lines Ls12 to Ls1*n* and output an on level signal to the select line Ls11.

When the select driver 14 outputs an off level signal to Ls12 to Ls1*n*, each of the transistors T1 and T2 of the pixels 11_1_12 to 21_*m*, . . . , 11*n* to 1*mn* are put off.

When each of the transistors T1 and T2 are put off, each of the transistors T3 are also put off. Current therefore does not flow at the pixels 11_12 to 11_m2, . . . , 11_1*n* to 11_mn, and the data lines Ld1 to Ldm are disconnected.

When the select driver 14 outputs an on level signal to the select line Ls11, each of the transistors T1 and T2 of the pixels 11_11 to 11_*ml* are put on. When the transistor T1 is put on, the transistor T3 is also put on.

The operation units 138-1 to 138-*m* of the correction circuits 134-1 to 134-*m* read out the light-emitting efficiencies η of the pixels 11_11 to 11_ml from the memories 137-1 to 137-*m*.

The operation units 138-1 to 138-*m* then correct the currents based on the read light-emitting efficiencies η and obtain the drive data Vdata based on the current correction values so as to acquire a brightness corresponding to the supplied image data.

The D/A converters 135-1 to 135-*m* of the data driver 13 converts the drive data Vdata acquired by the operation units 138-1 to 138-*m* to an analog negative write voltage Vd.

The control unit 15 then controls the switches 1312-1 to 1312-*m* so as to connect the data lines Ld1 to Ldm and the D/A converters 135-1 to 135-*m*.

When the data lines Ld1 to Ldm and the D/A converters 135-1 to 135-*m* are respectively connected, the D/A converters 135-1 to 135-*m* apply the negative write voltages Vd to the data lines Ld1 to Ldm.

At the pixels 11_11 to 11_*ml*, the cathodes of each of the organic EL elements 111 are connected to earth, and the anode lines La are also connected to earth potential. Current therefore does not flow from the anode circuit 12 to the organic EL elements 111.

The write voltages Vd are negative voltages. The current therefore flows from the anode circuit 12 via the anode lines La, each of the transistors T3 and T2 of the pixels 11_11 to 11_ml, and the data lines Ld1 to Ldm to the D/A converters 135-1 to 135-*m*.

Each of the transistors T1 of each of the pixels 11_11 to 11_*ml* are on. Each of the transistors T3 are therefore connected as a diode. This means that the transistors T3 operate within the saturation region as shown by the operation point P2 of FIG. 6 and a drain current Id corresponding to a diode characteristic flows at the transistor T3.

The transistors T1 are on and a drain current Id flows at the transistors T3. A gate voltage Vgs of the transistors T3 is therefore set to a voltage corresponding to the drain current Id and the capacitor C1 is charged by this gate voltage Vgs.

Writing is then carried out across the gates and sources of each of the transistors T3 of the pixels 11_11 to 11_*ml* using currents of values corrected using the voltages VEL so as to acquire a brightness corresponding to the supplied image data.

Next, the control unit 15 selects the pixels 11_12 to 11_*m*2 of the second row. In order to select the pixels 11_12 to 11_*m*2, the control unit 15 controls the select driver 14 so as to output an off level signal to the select lines Ls11 and Ls13 to Ls1*n* and output an on level signal to the select line Ls12.

When the select driver 14 outputs an off level signal to the select lines Ls11 and Ls13 to Ls1*n*, each of the transistors T1 and T2 for the pixels 11_11 to 11*ml*, 11_13 to 11_*m*3, . . . , and 11_1*n* to 11_*mn* are put off.

When each of the transistors T1 and T2 of the pixels 11_11 to 11_*ml* are off, the gate voltages Vgs of the transistors T3 are held at the voltages written to the capacitors C1.

When the select driver 14 outputs an on level signal to the select line Ls12, each of the transistors T1 and T2 of the pixels 21_12 to 11_*ml* are put on. When the transistor T1 is put on, the transistor T3 is also put on.

The operation units 138-1 to 138-*m* of the correction circuits 134-1 to 134-*m* read out the light-emitting efficiencies η of the pixels 11_11_12 to 11_11_*m*2 from the memories 137-1 to 137-*m*, corrects the current values so as to acquire brightness's corresponding to the supplied image data, and obtains the drive data Vdata based on the corrected current voltages.

The D/A converters 135-1 to 135-*m* of the data driver 13 converts the drive data Vdata acquired by the operation units 138-1 to 138-*m* to an analog negative write voltage Vd.

The data driver 13 then writes the drive data Vdata across the gates and sources of the transistors T3 of the selected pixels 11_12 to 11_*m*2 using the write voltage Vd.

The control unit 15 then sequentially selects the pixels 11_13 to 1_m3, . . . , 11_1n to 11_mn.

When writing is carried out for all of the pixels 11_ij, the control unit 15 controls each unit so that the organic EL elements 111 of each of the pixels 11_ij emit light.

Figure 20:
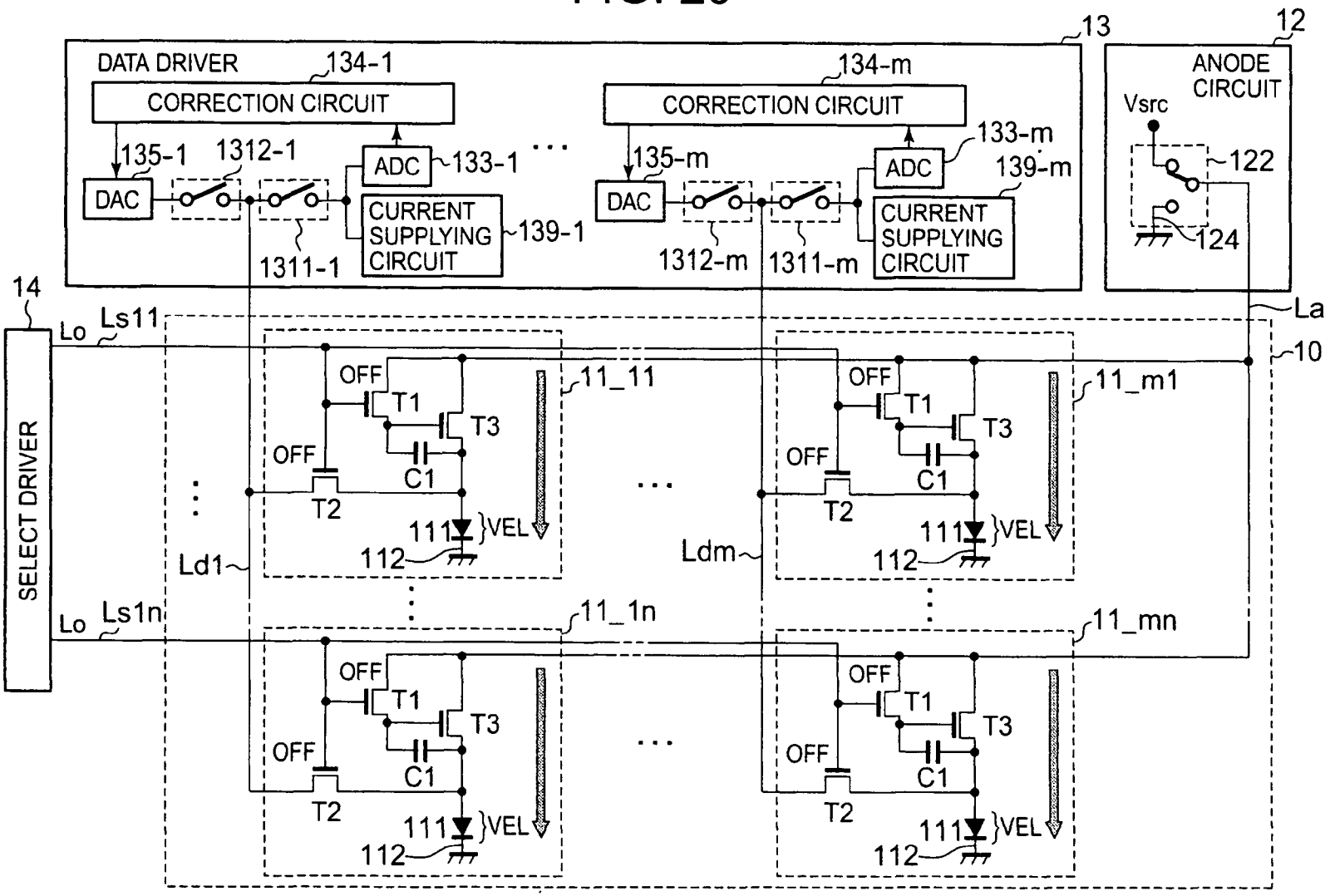
FIG. 20 is a diagram showing a light-emitting operation for the light-emitting device shown in FIG. 16.

As shown in FIG. 20, the control unit 15 then controls the switch 122 of the anode circuit 12 so as to connect the anode line La and the power supply of the voltage Vsrc.

The control unit 15 then continues to control the switches 1311-1 to 1311-m so that the data lines Ld1 to Ldm, the current supplying circuits 139-1 to 139-m of the data driver 13 and the A/D converters 133-1 to 133-m are disconnected.

The control unit 15 then controls the switches 1312-1 to 1312-m so as to disconnect the data lines Ld1 to Ldm and the D/A converters 135-1 to 135-m.

The select driver 14 then outputs an off level signal to the select lines Ls11 to Ls1n. When the select driver 14 outputs an off level signal to the select lines Ls11 to Ls1n, each of the transistors T1 and T2 for all of the pixels 11_ij are put off.

All of the pixels 11_ij are then disconnected from the data lines Ld1 to Ldm because each of the transistors T2 are put off.

However, a current flows at each of the transistors T3 because the drive data Vdata is written across the gates and sources of each of the transistors T3 of all of the pixels 11_ij.

When the voltage Vsrc is applied, the current flows from the anode circuit 12 via the anode line La and each of the transistors T3 of each of the pixels 11_ij to the organic EL elements 111.

FIG. 6 is a diagram showing a characteristic for a drain-source current Ids versus a drain-source voltage Vds for a transistor T3 and a load line SPe1 for the organic EL element 111. The gate voltages Vgs of the transistors T3 of each of the pixels 11_ij are held by the capacitors C1. An operating point of a transistor t3 is therefore an operating point P3 at an intersection point of an operating line for the held gate voltage Vgs and the load line SPe1 of the organic EL elements 111, as shown in FIG. 6. The voltage Vsrc is set to be a voltage where the operating point P3 is such that the transistor T3 operates in the saturation region.

In FIG. 6, P0 is a pinch off point, Vth is a threshold voltage, a region from where the voltage Vds across the drain and source is 0 V to the pinch-off voltage is an unsaturated region, and a region from where the drain-source voltage Vds is the pinch-off voltage or more is a saturation region.

A drain current Id that is the same as the write current when the drive data Vdata is written in flows across the drain and source of the transistor T3. The transistor T2 is therefore off and the potential of the anode side of the organic EL element 111 is higher than the potential of the cathode side. This drain current Id can therefore be supplied to the organic EL element 111.

At this time, the current flowing at the organic EL elements 111 of each of the pixels 11_ij is corrected based on the measured voltage VEL.

For example, if correction does not take place when brightness corresponding to the supplied image data with respect to the organic EL element 111 of the pixel 11_11 is 5000 cd/m$^2$ and the voltage VEL measured for the organic EL element 111 is 8.30 V, the brightness is 3000 cd/m$^2$ or less.

In this event, the light-emitting efficiency extraction unit 136-1 acquires a light-emitting efficiency $\eta$=0.6 from the voltage VEL=8.30 V by referring to the LUT shown in FIG. 4.

The operation unit 138-1 refers to the memory 137-1 and acquires $\eta$=0.6 and acquires a current correction value Iel_1 that is an initial current value Iel_0 of $1/\eta$=1.67 times as the current for acquiring a brightness of 5000 cd/m$^2$.

This is to say that correction takes place so that a current that is 1.67 times the initial current Iel_0 flows at the organic EL element 111 of the pixel 11_11. As a result, the organic EL element 111 emits light at a brightness of 5000 cd/m$^2$.

According to this embodiment, the control unit 15 controls each of the units so as to control the transistors T1 and T2 of each of the pixels 11_ij to go on every row, supply a constant current from the data driver 13 to the organic EL elements 111 of each of the pixels 11_ij, and measure the voltages VEL of the organic EL elements 111.

The data driver 13 corrects the current values based on the measured voltages VEL and writes the drive data Vdata across the gates and sources of the transistors T3 of each of the pixels 11_ij so as to obtain brightness's corresponding to the supplied image data.

Fluctuations in the characteristics of the organic EL elements 111 of each of the pixels 11_ij can therefore be compensated for.

A display device has RGB organic EL elements 111 arranged every column and measures the voltages VEL every column.

In the case of the three primary colors of R, G, and B, the light emitting material for the colours R, G, and B is usually applied every column. However, the extent of deterioration of an organic EL element 111 also differs for different materials. However, it is possible to measure the voltages VEL of the organic EL elements 111 generated by the same material without taking into consideration distinctions between the materials by measuring the voltages VEL every column.

Variations in the characteristics of the organic EL elements 111 of each of the pixels 11_ij can therefore be compensated for even when variations occur in the characteristics due to inconsistent application of light-emitting material.

The resistance of the light-emitting material is different to that of a metal and is high, as with semiconductors. When there are inconsistencies in the application of the light-emitting material, variations in the thickness of the applied light-emitting material also influence the characteristics of the organic EL elements 111.

However, it is possible to compensate for variations in characteristics of the organic EL elements 111 of each of the pixels 11_ij by measuring the voltages VEL of each of the organic EL elements 111 at the time of manufacture and the time of shipping etc. and correcting the current values based on the measured voltages VEL so as to acquire the brightness of the supplied image data.

Various forms can be considered for implementing the present invention and the present invention is by no means limited to the aforementioned embodiments.

For example, in the above embodiments, an explanation is given taking an organic EL element as a light-emitting element. However, the light-emitting element is not limited to being an organic EL element, and can, for example, also be an inorganic EL element or an LED.

The relationship between the light-emitting efficiency of the organic EL element and the voltage shown in FIG. 2 changes depending on the light emitting material of the organic EL element and is by no means limited to that described. Similarly, the LUT shown in FIG. 17 is by no means limiting.

In each of the above embodiments, an explanation is given of the case of application of the present invention to a display device having a light-emitting region where a plurality of pixels having the light-emitting elements are arranged in a matrix but the present invention is by no means limited in this respect. For example, application is also possible to a light-emitting device having a light emitting element every where a plurality of pixels having light-emitting elements are arranged in one direction and irradiate light emitted according to image data at a photosensitive drum to bring about exposure at an exposure device.

Various embodiments and changes may be made thereunto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

This application claims priorities based on Japanese Patent Application Nos. 2008-91882, 2008-92020 and 2009-38663 the entire disclosure of which is incorporated herein by reference in its entirety.

What is claimed is:

1. A light-emitting device comprising:

a power supply line;

at least one data line;

at least one pixel having a light-emitting element with one end electrically connected to the power supply line and another end set to a prescribed potential, and a first transistor connecting the data line(s) and one end of the light-emitting element;

a current supplying circuit that outputs a verification current of a preset value; and a data driver unit having voltage measuring circuits that acquire a voltage of the one end of the light-emitting element as the verification voltage when the verification current flows via a current path of the data line and the first transistor of the pixel, from the one end of the light-emitting element to the other end from the current supplying circuit via the power supply line.

2. The light-emitting device according to claim 1, the data driver unit further comprising a correction circuit that corrects drive data corresponding to externally supplied image data based on the verification voltage acquired by the voltage measuring circuit, and a drive signal supplying circuit that generates a drive signal based on the corrected drive data.

3. The light-emitting device according to claim 2, wherein the correction circuit further comprises:

a light-emitting efficiency extraction unit having a storage circuit pre-stored with a relationship between a light-emitting efficiency indicating a ratio of brightness with respect to an initial brightness when the light-emitting element possesses initial characteristics when the verification current flows at the light-emitting element and a voltage across terminals of the light-emitting element when the verification current flows in the light-emitting element, that extracts a value for the light-emitting efficiency corresponding to the verification voltage measured by the voltage measuring circuit based on the relationship between the light-emitting efficiency and the voltage across the terminals of the light-emitting element stored in the storage circuit; and an operation unit that carries out operations on the drive data based on the values for light-emitting efficiency extracted by the light-emitting efficiency extraction unit and corrects the drive data.

4. The light-emitting device according to claim 3, wherein the light-emitting device further comprises a light-emitting region where a plurality of the pixels are arranged, and the voltage measuring circuits of the data driver unit are controlled so as to acquire the verification voltage for one of the pixels of the plurality of pixels of the light-emitting region.

5. The light-emitting device according to claim 4, wherein a plurality of the pixels are arranged along a row direction and a column direction at the light-emitting region, a plurality of the data lines are arranged along the column direction of the light-emitting region;

the light-emitting device comprises a plurality of select lines arranged in a row direction orthogonal to each of the data lines and connected to each of the pixels at the light-emitting region, and select driver units that apply select signals to each of the select lines and set each of the pixels corresponding to each of the select lines to a selected state;

each of the pixels is arranged in a matrix in the vicinity of intersection points of each of the data lines and each of the select lines, with each of the pixels comprising a second transistor with one end of a current path connected to the power supply line and the other end of the current path connected to one end of the light-emitting element so as to electrically connect the power supply line and one end of the light-emitting element, and a voltage holding unit that holds a voltage across a control terminal of the second transistor and the other end of the current path; and the drive signal supplying circuit applies a first write voltage having a voltage value necessary for causing a current larger than the verification current to flow at the current path of the second transistor as a drive signal to the pixel that acquisition of the verification voltage is carried out for of the row put into a selected state by the select driver unit before the verification current flows in the light-emitting element, puts the second transistor in a conducting state, and applies a second write voltage of a value that puts the second transistor in a non-conducting state as a drive signal to the pixels of the row put into a selected state by the select driver unit with the exception of the one pixel the verification voltage is acquired for.

6. The light-emitting device according to claim 5, wherein each of the pixels comprises a third transistor with one end of a current path connected to the power supply line and the other end of the current path connected to the control terminal of the second transistor, the plurality of select lines comprise a plurality of first select lines connected to a control terminal of the third transistor of each of the pixels so as to be arranged in a row direction, and a plurality of second select lines connected to a control terminal of the first transistor of each of the pixels so as to be arranged in a row direction, the select driver unit comprises a first select driver unit that applies first select signals to each of the first select lines, and a second select driver unit that applies second select signals to each of the second select lines, and wherein conducting states are set individually for the first transistor and the third transistor by the first select driver unit and the second select driver unit.

7. The light-emitting device according to claim 5, wherein each of the pixels comprises a third transistor with one end of a current path connected to the power supply line and the other end of the current path connected to the control terminal of the second transistor, the plurality of select lines comprise a plurality of first select lines connected to a control terminal of the first transistor of each of the pixels so as to be arranged in a row direction, and a plurality of second select lines connected to a control terminal of the third transistor of each of the pixels so as to be arranged in a row direction, and the select driver unit comprises:

a first select driver unit that applies a first select signal to each of the first select lines, and a second select driver unit comprising a switch circuit having a plurality of switching elements that apply the second select signal to each of the second select lines based on the first select signal, and a switch driver circuit that controls the operation of each of the transistors of the switch circuit, wherein conducting states are set individually for the first transistor and the third transistor by the first select driver unit and the second select driver unit.

8. The light-emitting device according to claim 7, the switch circuit comprising a plurality of first switching elements provided corresponding to each of the rows of the light-emitting region, with one end of a current path connected to each of the second select lines, and the other end of the current path being set to a prescribed potential, a plurality of second switching elements provided corresponding to each of the rows of the light-emitting region, connecting both ends of a current path to the first select lines and the second select lines connected to the pixels of each of the rows, a first control signal line connected in common to the control terminals of each of the first switching elements, and a second control signal line connected in common to the control terminals of each of the second switching elements, wherein the switch drive circuit individually applies control signals for controlling conduction of each of the first switching elements and each of the second switching elements to the first control signal line and the second control signal line.

9. The light-emitting device according to claim 3, wherein the light-emitting device further comprises a light-emitting region where a plurality of the pixels are arranged, the plurality of pixels are arranged along a row direction and a column direction in a matrix at the light-emitting region;

a plurality of the data lines are arranged along the column direction of the light-emitting region;

current outputted from the current supplying circuit flows simultaneously to the light-emitting elements for all of the pixels of the light-emitting region, and a plurality of the voltage measuring circuits of the data driver unit are provided corresponding to each of the plurality of data lines, each of the current measuring circuits are arranged along the column direction of the light-emitting region and acquire average values for the verification voltages of the plurality of pixels connected individually to the plurality of data lines.

10. The light-emitting device according to claim 5, wherein the light-emitting device further comprises a light-emitting region where a plurality of the pixels are arranged, the plurality of pixels are arranged in a matrix along the row direction and the column direction at the light-emitting region, a plurality of the data lines are arranged along the column direction, current outputted from the current supplying circuit flows simultaneously to the light-emitting elements for the plurality of pixels arranged along any one row of the light-emitting region, and a plurality of the voltage measuring circuits of the data driver unit are provided corresponding to each of the plurality of data lines, and each of the current measuring circuits acquires the verification voltages of each of the pixels arranged along the one row of the light-emitting region in parallel.

11. A display device comprising:

a power supply line;

a plurality of data lines;

a plurality of pixels having a light-emitting element connected to any of the plurality of data lines, with one end electrically connected to the power supply line and at the end set at a prescribed potential, and a first transistor connecting each of the data lines and one end of the light-emitting element;

a current supplying circuit that outputs a verification current of a preset value; and a data driver unit having voltage measuring circuits that acquire a voltage of one end of a light-emitting element when a verification current flows from one end of the light-emitting element to the other end from the current supplying circuit via the power supply line via a current path of each of the data lines and the first transistor of at least one pixel of the plurality of pixels as a verification voltage, a correction circuit that corrects drive data according to externally supplied image data based on the verification voltages acquired by the voltage measuring circuits, and a drive signal supplying circuit that generates a drive signal based on the corrected drive data.

12. The display device according to claim 11, wherein the correction circuit further comprises:

a light-emitting efficiency extraction unit having a storage circuit pre-stored with a relationship between a light-emitting efficiency indicating a ratio of brightness with respect to an initial brightness when the light-emitting element possesses initial characteristics when the verification current flows at the light-emitting element and a voltage across terminals of the light-emitting element when the verification current flows in the light-emitting element, that extracts a value for the light-emitting efficiency corresponding to the verification voltage measured by the voltage measuring circuit based on the relationship between the light-emitting efficiency and the voltage across the terminals of the light-emitting element stored in the storage circuit; and an operation unit that carries out operations on the drive data based on the values for light-emitting efficiency extracted by the light-emitting efficiency extraction unit and corrects the drive data.

13. The display device according to claim 12, wherein the display device further comprises a light-emitting region where a plurality of the pixels are arranged, and the voltage measuring circuits of the data driver unit are controlled so as to sequentially acquire the verification voltages every one of the pixels of the plurality of pixels of the light-emitting region.

14. The display device according to claim 12, wherein the display device further comprises a light-emitting region where the plurality of pixels are arranged in a matrix along to a row direction and a column direction, a plurality of the data lines are arranged along the column direction of the light-emitting region;

current outputted from the current supplying circuit flows simultaneously to the light-emitting elements for all of the pixels of the light-emitting region, and a plurality of the voltage measuring circuits of the data driver unit are provided corresponding to each of the plurality of data lines, each of the current measuring circuits are arranged along the column direction of the light-emitting region and acquire average values for the verification voltages of the plurality of pixels connected individually to the plurality of data lines.

15. The display device according to claim 12, wherein the display device further comprises a light-emitting region where the plurality of pixels are arranged in a matrix along to a row direction and a column direction, a plurality of the data lines are arranged along the column direction, current outputted from the current supplying circuit flows simultaneously to the light-emitting elements for the plurality of pixels arranged along any one row of the light-emitting region, and a plurality of the voltage measuring circuits of the data driver unit are provided corresponding to each of the plurality of data lines, and each of the current measuring circuits acquires the verification voltages of each of the pixels arranged along the one row of the light-emitting region in parallel.

16. A method for controlling driving of a light-emitting device for driving a light-emitting device having light-emitting elements, the light-emitting device having at least one pixel comprising a power supply line, at least one data line, a light-emitting element with one end electrically connected to the power supply line and another end set to a prescribed potential, and a first transistor connecting the data line and one end of the light-emitting element, and a current supplying circuit that outputs a verification current having a preset value, comprising the steps of:

having the verification current flow from the current supplying circuit from one end of the light-emitting element to the other end of the light-emitting element via the power supply line; and acquiring a voltage of the one end of the light-emitting element when the verification current flows from the one end of the light-emitting element to the other end of the light-emitting element via a current path of the data line and the first transistor.

17. The method for controlling driving of the light-emitting device according to claim 16, wherein:

correcting drive data corresponding to externally supplied image data based on the acquired value of the verification voltage; and generating a drive signal based on the connected drive data and supplying the drive signal to the pixel(s) via the data line.

18. The method for controlling driving of the light-emitting device according to claim 17, wherein:

the step of correcting the drive data comprises the steps of:

extracting a value for the light-emitting efficiency corresponding to the verification voltage acquired in the step of acquiring the voltage of the one end of the light-emitting element based on the relationship between the light-emitting efficiency and the voltage across the terminals of the light-emitting element stored in the storage circuit pre-storing a relationship between the light-emitting efficiency indicating a ratio of brightness with respect to an initial brightness when the light-emitting element possesses initial characteristics when the verification current flows at the light-emitting element and a voltage across the terminals of the light-emitting element when the verification current flows in the light-emitting element; and carrying out operations on the drive data so as to correct the drive data based on the extracted light-emitting efficiency.

19. The method for controlling driving of the light-emitting device according to claim 16, wherein:

the light-emitting device further comprises a light-emitting region where a plurality of the pixels are arranged along a row direction and a column direction, in the step of the verification current flowing from one end of the light-emitting element to the other end, the verification current outputted by the current supplying circuit flows out the light-emitting element of one of the pixels of the plurality of pixels of the light-emitting region, and the step of acquiring the voltage of the one end of the light-emitting element includes sequentially measuring the verification voltages of the plurality of pixels arranged at the light-emitting region.

20. The method for controlling driving of the light-emitting device according to claim 16, wherein:

the light-emitting device further comprises a light-emitting region where the plurality of the pixels are arranged along a row direction and a column direction, with a plurality of the data lines being arranged along the column direction;

in the step of the verification current flowing from one end of the light-emitting element to the other end, the verification current outputted by the current supplying circuit flows at the light-emitting elements of all of the pixels of the light-emitting region simultaneously; and the step of acquiring the voltage of the one end of the light-emitting element includes a step of measuring an average value for the verification voltages for the plurality of pixels arranged along a column direction of the light-emitting region.

21. The method for controlling driving of the light-emitting device according to claim 16, wherein:

the light-emitting device further comprises a light-emitting region where the plurality of the pixels are arranged along a row direction and a column direction, with a plurality of the data lines being arranged along the column direction;

in the step of the verification current flowing from one end of the light-emitting element to the other end, the verification current outputted by the current supplying circuit flows at the light-emitting elements of the plurality of pixels arranged along one row of the light-emitting region simultaneously; and the step of acquiring a voltage of one end of the light-emitting elements includes a step of acquiring the verification voltages of each of the pixels arranged along the one row of the light-emitting region in parallel.

22. A light-emitting device having pixels equipped with light-emitting elements, comprising:

a light-emitting region with the plurality of pixels arranged in the vicinity of intersection points of the plurality of select lines and data lines arranged in a row direction and a column direction; and a data driver unit that generates a drive signal according to externally supplied image data and supplies the drive signal to each of the pixels via the data lines, wherein each pixel comprises a current control transistor with one end of a current path connected to the power supply line and the other end of the current path connected to one end of the light-emitting element, that controls the flow of current in the light-emitting element, and a select control transistor with one end of a current path connected to the data line and the other end of the current path connected to a connection point of the other end of the current path of the current control transistor and the light-emitting element, and with a control terminal connected to the select line, and the data driver unit comprises a plurality of current supplying circuits that supply individual prescribed verification currents to each of the plurality of data lines, and a plurality of voltage measuring circuits that measure the voltages across the terminals of each of the light-emitting elements when the verification currents flow from each of the current supplying circuits via the current path of the select control transistors of each of the pixels at each of the light-emitting elements as verification voltages via the select control transistors.

23. The light-emitting device according to claim 22, further comprising a select driver unit that applies select signals to each of the select lines of a display panel and sets selected states at the pixels of each row, wherein the data driver unit measures the verification voltages for the pixels of a row set to the selected state by the select driver unit.

24. The light-emitting device according to claim 23, wherein the data driver unit comprises a correction circuit that corrects drive data according to the image data based on the verification voltages measured by the voltage measuring circuit, and a drive signal supplying circuit that generates the drive signal based on the corrected drive data.

25. The light-emitting device according to claim 24, wherein the correction circuit comprises a storage circuit that stores a relationship between light-emitting efficiency indicating a ratio of brightness with respect to an initial brightness when the light-emitting element possesses an initial characteristic when the verification current flows at the light-emitting element and a voltage across the end of the light-emitting element when the verification current flows out the light-emitting element, and an emitted light extracting unit that extracts the light-emitting efficiency corresponding to the verification voltage measured by the voltage measuring circuit based on the relationship between the light-emitting efficiency and the voltage across the terminals of the light-emitting element stored in the storage circuit.

26. The light-emitting device according to claim 25, the correction circuit further comprising an operation unit that performs operations on the drive data so as to correct the drive data based on the values for light-emitting efficiency extracted by the light-emitting efficiency extraction unit.

27. A method for controlling driving of a light-emitting device having pixels equipped with light-emitting elements, wherein a plurality of the pixels of the light-emitting device are arranged in the vicinity of each intersection point of a plurality of select lines and data lines arranged in a row direction and a column direction at a light-emitting region, the pixels comprising a current control transistor with one end of a current path connected to the power supply line and the other end of the current path connected to the one end of the light-emitting element, that controls the flow of current in the light-emitting element, and a select control transistor with one end of a current path connected to the data line and the other end of the current path connected to a connection point of the other end of the current path of the current control transistor and the light-emitting element, and with a control terminal connected to the select line, said method comprising the steps of:

supplying a prescribed verification current to each of the plurality of data lines, and causing the verification current to flow at each of the light-emitting elements via the current path of the select control transistors of each of the pixels of the rows put into a selected state;

measuring the voltages across the terminals of each of the light-emitting elements as the verification voltages via the select control transistor; and correcting the drive data according to externally supplied image data based on the measured verification voltages.

28. The method for controlling driving of the light-emitting device according to claim 27, wherein:

the step of correcting the drive data comprises the steps of:

pre-storing a relationship between light-emitting efficiency indicating a ratio of brightness with respect to an initial brightness when the light-emitting element possesses initial characteristics when the verification current flows to the light-emitting element, and a voltage across the terminals of the light-emitting element when the verification current flows to the light-emitting element;

extracting a value corresponding to the light-emitting efficiency corresponding to the measured verification voltage based on the relationship between the light-emitting efficiency and the voltage across the terminals of the light-emitting element; and correcting the drive data corresponding to the image data based on the extracted light-emitting efficiency.

29. The method for controlling driving of the light-emitting device according to claim 27, wherein:

the verification current flows in the light-emitting elements of each of the pixels for one row of the display panel that is put in the selected state in the step of the verification current flowing; and executing measuring of the verification voltages of each of the pixels that are arranged the one row of the display panel in parallel in the step of measuring the verification current.

* * * * *